US008608559B2

(12) United States Patent
Atkinson

(10) Patent No.: US 8,608,559 B2
(45) Date of Patent: Dec. 17, 2013

(54) CUSTOMER RELATIONSHIP MANAGEMENT SYSTEMS AND METHODS FOR USE WITH ELECTRONIC GAMING MACHINES

(75) Inventor: Keith Atkinson, Henderson, NV (US)

(73) Assignee: Joshua Trading, LLC, Henderson, NV (US)

( * ) Notice: Subject to any disclaimer, the term of this patent is extended or adjusted under 35 U.S.C. 154(b) by 325 days.

(21) Appl. No.: 13/093,719

(22) Filed: Apr. 25, 2011

(65) Prior Publication Data

US 2011/0263325 A1 Oct. 27, 2011

Related U.S. Application Data

(63) Continuation-in-part of application No. 12/474,627, filed on May 29, 2009.

(60) Provisional application No. 61/099,857, filed on Sep. 24, 2008, provisional application No. 61/327,470, filed on Apr. 23, 2010, provisional application No. 61/355,960, filed on Jun. 17, 2010, provisional application No. 61/371,114, filed on Aug. 5, 2010, provisional application No. 61/390,573, filed on Oct. 6, 2010, provisional application No. 61/414,173, filed on Nov. 16, 2010, provisional application No. 61/434,356, filed on Jan. 19, 2011.

(51) Int. Cl.
*G07F 17/32* (2006.01)

(52) U.S. Cl.
USPC ..... 463/29

(58) Field of Classification Search
USPC ..... 463/25, 26, 29
See application file for complete search history.

(56) References Cited

U.S. PATENT DOCUMENTS

| | | | |
|---|---|---|---|
| 5,941,772 | A | 8/1999 | Paige |
| 5,971,271 | A | 10/1999 | Wynn et al. |
| 6,089,975 | A | 7/2000 | Dunn |
| 6,113,495 | A | 9/2000 | Walker et al. |
| 6,253,119 | B1 | 6/2001 | Dabrowski |
| 6,263,258 | B1 | 7/2001 | Dabrowski |
| 6,315,666 | B1 | 11/2001 | Mastera et al. |
| 6,379,246 | B1 | 4/2002 | Dabrowski |
| 6,540,609 | B1 | 4/2003 | Paige |
| 6,598,788 | B1 | 7/2003 | Dabrowski |
| 6,712,698 | B2 | 3/2004 | Paulsen et al. |
| 6,860,810 | B2 | 3/2005 | Cannon et al. |
| 6,942,574 | B1 | 9/2005 | LeMay et al. |
| 7,335,106 | B2 | 2/2008 | Johnson |
| 7,520,810 | B2 | 4/2009 | Dabrowski |
| 8,083,592 | B2 | 12/2011 | Wells |
| 8,088,014 | B2 | 1/2012 | Wells |
| 8,282,480 | B2 | 10/2012 | Wells et al. |
| 8,371,937 | B2 | 2/2013 | Wells |
| 8,388,424 | B2 | 3/2013 | Dabrowski |
| 2007/0243928 | A1* | 10/2007 | Iddings ..... 463/26 |
| 2013/0072310 | A1 | 3/2013 | Wells |

* cited by examiner

*Primary Examiner* — Thomas L Dickey
(74) *Attorney, Agent, or Firm* — Howard & Howard Attorneys PLLC

(57) ABSTRACT

Systems and methods connected to, or in communication with, various components operatively associated with electronic gaming machines which are configured to provide access to applications and features through the electronic gaming machine that facilitate patron services.

23 Claims, 22 Drawing Sheets

Detect a data signal from EGM
12
10
Begin recording passage of time
14
Compare time with threshold time period
16
No
Yes
Second data signal detected?
No
Has threshold been met?
18
20
Yes
Continue transmitting presentation data
26
No
Trigger transmission of presentation data
Second data signal detected?
24
22
Yes
Terminate transmission of presentation data
28

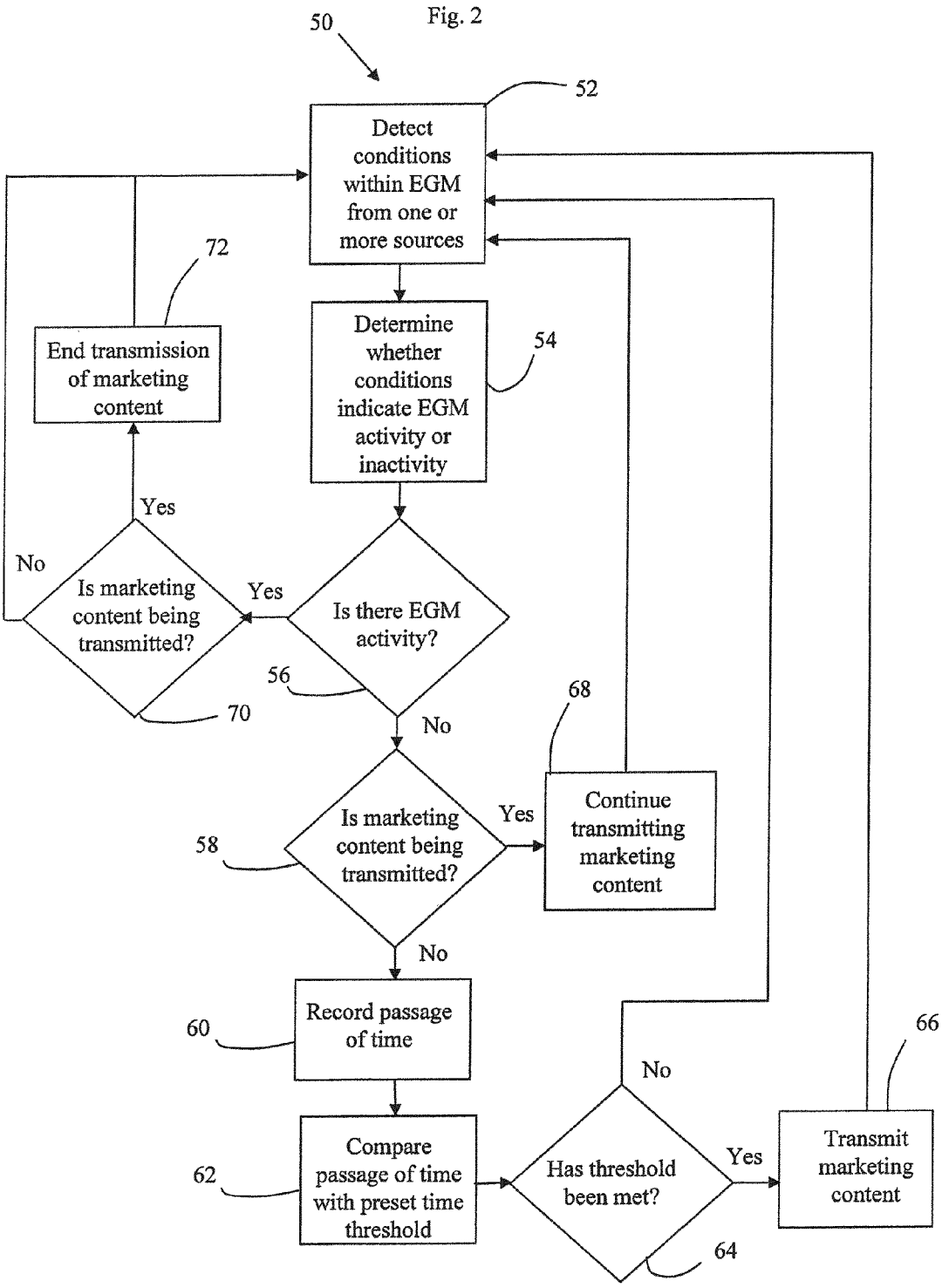
Fig. 2
50
52
Detect conditions within EGM from one or more sources
72
End transmission of marketing content
Determine whether conditions indicate EGM activity or inactivity
54
Yes
No
Is marketing content being transmitted?
Yes
Is there EGM activity?
56
70
68
No
Is marketing content being transmitted?
Yes
Continue transmitting marketing content
58
No
Record passage of time
60
66
No
Compare passage of time with preset time threshold
62
Has threshold been met?
Yes
Transmit marketing content
64

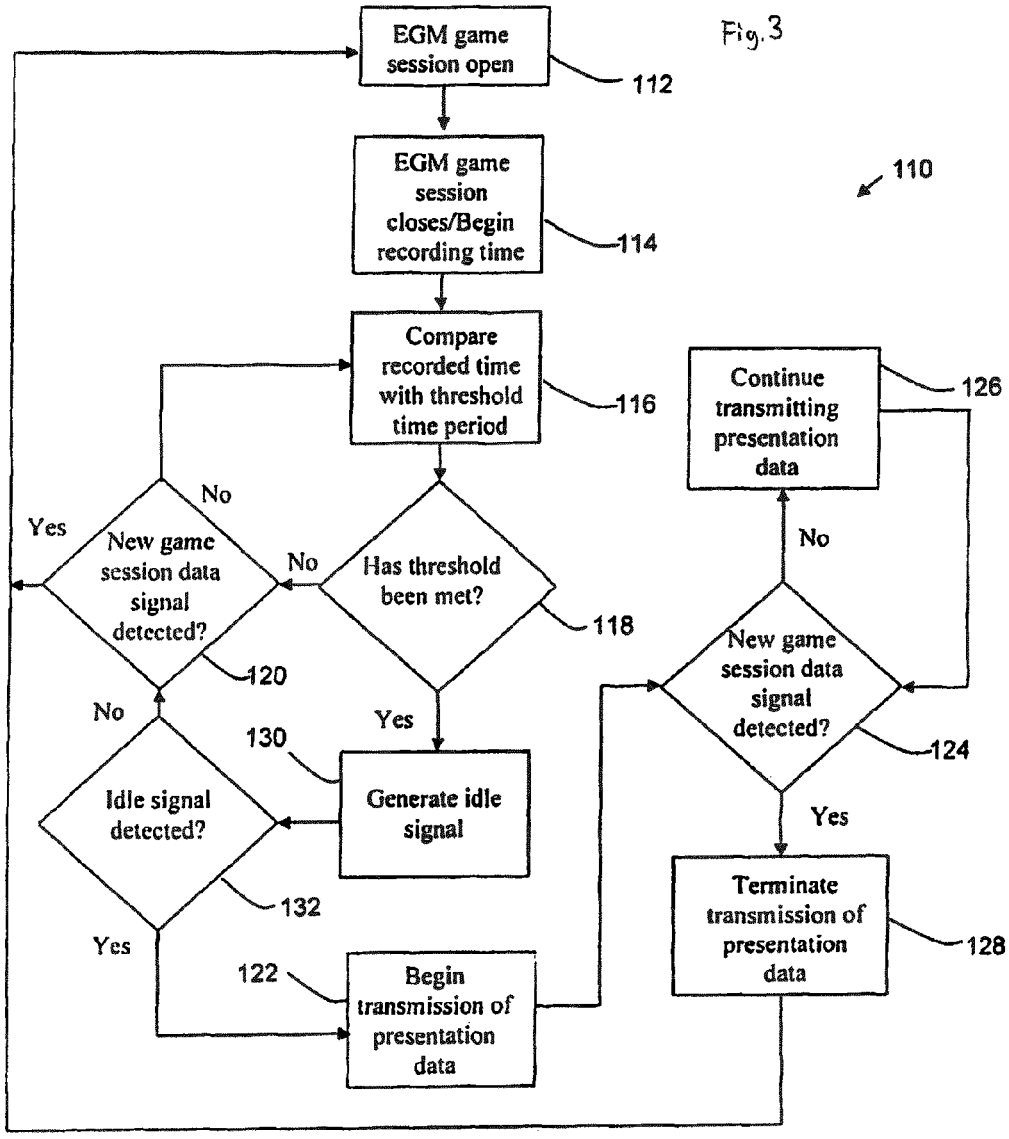
Fig. 3
110
EGM game session open
112
EGM game session closes/Begin recording time
114
Compare recorded time with threshold time period
116
Has threshold been met?
118
Yes
No
New game session data signal detected?
120
Yes
No
Generate idle signal
130
Idle signal detected?
132
Yes
No
Begin transmission of presentation data
122
Continue transmitting presentation data
126
New game session data signal detected?
124
No
Yes
Terminate transmission of presentation data
128

CUSTOMER RELATIONSHIP MANAGEMENT SYSTEMS AND METHODS FOR USE WITH ELECTRONIC GAMING MACHINES

CROSS-REFERENCE TO RELATED APPLICATIONS FROM WHICH PRIORITY IS CLAIMED

This application claims the benefit of U.S. patent application Ser. No. 12/474,627 filed May 29, 2009 (which claims priority to U.S. Provisional Patent Application No. 61/099,857, filed Sep. 24, 2008), U.S. Provisional Application No. 61/327,470 filed Apr. 23, 2010, U.S. Provisional Application No. 61/355,960 filed Jun. 17, 2010, U.S. Provisional Application No. 61/371,114 filed Aug. 5, 2010, U.S. Provisional Patent Application No. 61/390,573 filed Oct. 6, 2010, U.S. Provisional Patent Application No. 61/414,173 filed Nov. 16, 2010 and U.S. Provisional Patent Application No. 61/434,356 filed Jan. 19, 2011, the disclosures of which are incorporated herein by reference.

FIELD OF THE INVENTION

The embodiments of the present invention are directed to systems and methods for turning electronic wagering games into customer relationship management and marketing systems while the electronic game is inactive.

BACKGROUND OF THE INVENTION

Electronic gaming machines (EGM), such as a slot machines, video poker, blackjack or keno machines, typically include an outer cabinet that houses a main controller, several peripheral devices, and wiring harnesses to electrically connect the peripheral devices to the main controller. The main controller may, for example, include one or more printed circuit boards carrying one or more processors, a plurality of logic devices, and one or more memory devices for storing executable program code and game data. The memory devices for storing executable code may, for example, include EPROMS, hard disk drives, SD-Cards, Compact FLASH cards, CD-ROMs, DVDs, and Smart Media cards. The stored executable code provides two basic functions, namely, providing an operating system for controlling the gaming machine and handling communications between the gaming machine and an external network, and the game code for conducting a game on the gaming machine. While not in use, the EGM is typically programmed to display a menu of the games offered on its main display screen.

SUMMARY OF THE INVENTION

The embodiments of the present invention are directed to systems and methods for providing an alternative presentation to the EGM display while the EGM is inactive.

In one embodiment, there is a support structure for a marketing device of the embodiments of the present invention. The support structure may be embodied by a housing or other suitable body for securing components of the embodiments of the present invention. The support structure may be installed anywhere on the interior or exterior of the EGM.

The marketing device of the embodiments of the present invention includes a connection with the EGM through the SMIB (Slot Machine Interface Board), or other EGM device which handles external communications between the EGM and an external network, for the purpose of detecting data signals (or the lack thereof) or another indicator of EGM inactivity.

In one embodiment, the marketing device is connected to the EGM via a SMIB or other printed circuit board in communication with the EGM by a serial cable or other data communication link to a port, such as an RS-232, RS422, RS485 ports, and is capable of detecting SAS communication in the form of protocol data signals which are generated by the EGM as a result of normal user-initiated EGM activity, such as using the bill validator, game start, access door open, depressing buttons, coin in, screen touch or other indication of entry by the EGM into a pre-game start mode. In some embodiments, the marketing device is connected so that it can detect SAS communication but is configured so that it does not impact such communications, that is, it only receives data passively without transmitting data or otherwise affecting the transmissions detected. In some embodiments, the marketing device connection with an EGM is independent of the EGM operating system, although the marketing device is able to detect communication or signals generated by the EGM operating system.

The marketing device of the embodiments of the present invention may further include a data communication intercept component which is configured to allow for the preemption of the transmission of display data from the main game control board, or other device for controlling the one or more games displayed on the EGM display, upon being triggered by the delivery of presentation data to the intercept component. So long as presentation data or content, or marketing data or content, is not delivered, the intercept component is configured to allow the display data to bypass the intercept component without disruption.

In one embodiment, the intercept component is configured to receive the VGA compatible cable or other data communication link which supplies the video data from the EGM main game control board and deliver the video data via a data communication link with the EGM main video monitor. The delivery of presentation data to the intercept component triggers a data stream switch so that the presentation data preempts the transmission of video data. Thus, the presentation data will be displayed on the EGM main video monitor rather than the typical inactive mode video data.

A memory device for storing or supplying the presentation data is operatively associated with the marketing device. The memory may be affixed to the support structure or may be an independent, remote memory device configured for supplying the presentation data to the marketing device through a wired or wireless connection. The memory device may be of any conventional kind for storing accessible data. The presentation data may consist of audio, graphics, video, or multimedia data. It is envisioned that the presentation data may be intended for advertising or promotional purposes, however, the presentation data may be intended for other purposes and directed to any subject.

The marketing device of the embodiments of the present invention may include control programming and a processor for recording or otherwise keeping track of the passage of time after detecting a first data signal through the connection with the EGM SMIB, and time sync with the video server and monitoring the passage of time thereafter, comparing the passage of time with a preset timing threshold value, triggering the transmission of presentation data to the data communication intercept upon the passage of time reaching the preset threshold value, and terminating the transmission upon detecting a second data signal.

Although the preset timing threshold value may be set to any value by the operator (e.g., seconds, minutes or hours), it is envisioned that a value is selected that best estimates the time at which the EGM is inactive, that is, a game is not being played by a user. In some embodiments, once the transmission of presentation data begins, it will continue until a data signal is detected through the connection with the SMIB, thus indicating that the EGM has been made active by user actuation.

In some embodiments, the EGM may include peripheral devices, such as a touchscreen, which do not generate SAS communication. In such embodiments, the marketing device may have additional connections for determining if such devices are activated. For example, if the EGM has a touchscreen, the marketing device can be configured to detect if the touchscreen is touched and terminate the transmission of presentation data and return to the normal EGM display in response. Thereafter, the marketing device may keep track of the passage of time and if no further activity is detected, the marketing device may again preempt the normal EGM display for the transmission of presentation data.

In this manner the marketing device does not change, alter or affect the manner or mode of play of the EGM. Rather, the marketing device only affects what the video monitor of the EGM will be displaying while the EGM is inactive and not being played by a user. The marketing device also does not change, alter or affect the game controller, the game erasable programmable read-only memory (EPROM), the game graphics or the theoretical hold of the EGM. The marketing device of the embodiments of the present invention is configured to remain inactive during all forms of interaction and play on the EGM by a user. The marketing device merely detects signals that are normally generated internally by the EGM, via the connection with the SMIB or any other suitable point at which such signals may be detected.

Some embodiments are directed to a system configured for an electronic gaming device having at least a controller, memory, game player interface and display. The system includes a gaming device status detector configured to passively detect the status of the electronic gaming device and differentiate between detected status conditions associated with gaming machine activity and detected status conditions associated with gaming machine inactivity. This embodiment also includes a marketing content supplying device configured to transmit marketing content to the display responsive to the detection of status conditions associated with gaming machine inactivity. The marketing content supplying device may further be configured to transmit the marketing content after the passage of a preset period of time from the detection of status conditions associated with gaming machine inactivity as well as cease the transmission of said marketing content to the display responsive to detection of status conditions associated with gaming machine activity by said detecting means.

In some embodiments, the aforementioned system may include a preemption device configured to prevent pre-existing internal gaming machine inactivity content from being displayed on the display in favor of displaying the transmitted marketing content on the display until the transmission of the marketing content ceases. In some embodiments, the detected conditions associated with gaming machine activity and gaming machine inactivity are preset to facilitate the differentiation thereof by the gaming device status detecting means.

In some embodiments, the gaming device status detector is in communication or otherwise connected with one or more components of the electronic gaming device for detecting various parameters relating to the components that can be used to determine the status condition, namely whether the gaming machine is active or inactive. In some embodiments, the detector in a system such as the aforementioned system is further configured to differentiate status conditions associated with game play by detecting data signals relating to one or more of the following: bill validator usage, game player interface usage, coin in detection, game card usage and touch screen usage.

In some embodiments, the aforementioned system further includes memory which can communicate with the marketing content supplying device and is configured for storing the marketing content.

In some embodiments, the aforementioned system further includes a device or configuration for receiving marketing content from a remote source.

In some embodiments, the aforementioned system further includes a data stream switch having multiple data stream inputs. In such embodiments, the data stream switch is configured for outputting the marketing content upon detection of the transmission of marketing content from the marketing content supplying means regardless of other data stream input to the switch.

Some other embodiments are directed to a system configured for an electronic gaming device having at least a controller, memory, game player interface and display which includes a data processor and a data stream switch, which may have multiple data stream input sources and an output in communication with the electronic gaming device display. The data processor is operatively associated with the electronic gaming device for passively detecting conditions within the electronic gaming device, differentiating between conditions associated with gaming device activity and conditions associated with gaming device inactivity, actuating a transmission of marketing content in response to the passage of a preset period of time after detecting conditions associated with gaming device inactivity, and ending the transmission of marketing content in response to the detection of conditions associated with gaming device activity, among other things. The data stream switch is configured to receive the transmission of marketing content actuated by the data processor as an input, wherein the data stream switch is further configured to output the marketing content for display on the electronic gaming device display by automatically preempting any pre-existing gaming device inactivity content input from being outputted for display on electronic gaming device while receiving the transmission of marketing content, among other things. It should be understood that the data processor of some embodiments may further embody or access control programming, firmware or software to facilitate the functions or configurations described herein.

The conditions detected, that is, conditions associated with either gaming device activity or inactivity, may include data signals generated by a component within the gaming device. The conditions detected may also include voltage or current changes within the electronic gaming device or relating to a component thereof.

In some embodiments, the aforementioned system further includes a data storage device in communication with the data processor and data stream switch for storing marketing content. In some embodiments, the data processor and data stream switch are mounted within the electronic gaming device, while in other embodiments one or both of these components are independent of the electronic gaming device.

In some embodiments, a data stream switch in a system such as the aforementioned system is configured for receiving marketing content from a remote source. The remote source may communicate via a wired or wireless connection with the data stream switch.

In some embodiments, a data processor in a system such as the aforementioned system is further configured to maintain records relating to the duration of time the marketing content is transmitted.

In some embodiments, wherein the data processor is further configured for determining the display characteristics of the pre-existing gaming device inactivity content or game idle content, and adjusting the display characteristics of the marketing content to substantially match the display characteristics of the pre-existing gaming device inactivity content for display on the electronic gaming device display.

Some embodiments are directed to a method of presenting marketing content via an electronic gaming machine including at least a controller, memory, game player interface and display. The method includes the steps of: detecting data signals generated by the electronic gaming device during play sessions and idle time; tracking time after detecting a data signals associated with idle time; triggering a transmission of marketing content to the display responsive to the tracked time after detection of the data signal exceeding a threshold period of time; and ceasing the transmission of said marketing content to the display responsive to detection of a subsequent data signal associated with play sessions.

In some embodiments, the aforementioned method further includes transmitting marketing content to the display from a remote source or local source, or a combination thereof.

In some embodiments, the aforementioned method further includes the step of preempting pre-existing internal game idle content from being displayed in favor of displaying said marketing content.

Some embodiments are directed to an EGM configured for providing an interactive game which includes a display, memory containing display content including game play content, a player interface for inputting information and player selections relating to the interactive game, and a game controller configured for facilitating game play of the interactive game, including receiving information from the player interface and providing game content on the display during game play. The aforementioned EGM further includes a data processor and a data stream switch. The data processor is configured for passively detecting data communication within the gaming machine, differentiating between the data communication associated with game play and the data communication associated with a game idle state, actuating a transmission of marketing content in response to the detection of data communication associated with a game idle state and ending the transmission of marketing content in response to the detection of data communication associated with game play, among other things. The data stream switch may include multiple data stream input sources and an output in communication with the display, among other things. The data stream switch may further be configured to receive the transmission of marketing content actuated by the data processor as a data stream input, preempt any other display content input from being outputted by the data stream switch for display and output the marketing content being received by the data stream switch for display while the transmission is received.

In some embodiments, the display content in an EGM such as the aforementioned EGM further includes game idle content, and the game controller is further configured to present the game idle content on the display during the game idle state. In some of these embodiments, the data stream switch may be further configured to automatically preempt the display of game idle content upon receiving the transmission of marketing content, and the data processor may be further configured to actuate the transmission of marketing content after a preset period of time from the detection of data communication associated with a game idle state.

The data processor and data stream switch may be integral with the EGM or mounted independently. In some embodiments, the aforementioned EGM also includes a data storage device containing the marketing content.

In some embodiments, the invention is further directed to a system configured for an electronic gaming device, said electronic gaming device having at least a controller, memory, game player interface and display, which includes: gaming device status detecting means configured to passively detect the status of the electronic gaming device and differentiate between detected status conditions associated with gaming machine activity and detected status conditions associated with gaming machine inactivity; and menu transmission means configured for receiving a menu actuating signal and transmitting menu content on the display responsive to the menu actuating signal and the detection of status conditions associated with gaming machine inactivity, the menu content transmitted to the display including one or more selectable options for actuating further transmissions of menu content, wherein the menu delivery means is further configured to cease the transmission of the menu content to the display responsive to detection of status conditions associated with gaming machine activity by the detecting means.

In some embodiments, the aforementioned system further includes a display device configured to display a menu actuator object on the display with pre-existing internal gaming machine display content. The system may also include memory in communication with the menu transmission means for storing the menu content and a data stream switch having multiple data stream inputs, wherein the data stream switch is configured for outputting the menu content regardless of other data stream input.

In some embodiments, the invention is directed to a system configured for an electronic gaming device, said electronic gaming device having at least a controller, memory, ticket printer, game player interface and display, including: a data processor operatively associated with the electronic gaming device for passively detecting conditions within the electronic gaming device, differentiating between conditions associated with gaming device activity and conditions associated with gaming device inactivity, actuating a transmission of menu content in response to the passage of a preset period of time after detecting conditions associated with gaming device inactivity and receiving a menu content actuation signal initiated at the electronic gaming device, and ending the transmission of menu content in responsive to one of either detecting conditions associated with gaming device activity or receiving a game actuation signal initiated at the electronic gaming device; and a data stream switch having multiple sources of data stream input and an output in communication with the display of the electronic gaming device, wherein the data stream switch is configured to receive the transmission of menu content actuated by the data processor as a data stream input, wherein the data stream switch is further configured to facilitate the display of menu content on the electronic gaming device display by outputting the menu content for display and automatically preempting any pre-existing gaming device inactivity content input from being displayed on the display of the electronic gaming device while receiving the transmission of menu content.

In some embodiments, the data processor is further configured for determining the display characteristics of the pre-existing gaming device inactivity content and adjusting the display characteristics of the menu content to substantially match the display characteristics of the pre-existing gaming device inactivity content for display on the electronic gaming device display. The system may also be configured for receiving a signal to print a ticket during transmission of menu content from the ticket printer.

In some embodiments, the invention is directed to a method of presenting menu content via an electronic gaming machine, said electronic gaming machine including at least a controller, memory, game player interface and touch screen display, comprising the steps of: displaying an object at a preset position on the touch screen display; detecting data signals generated by the electronic gaming device during play sessions and idle time; and transmitting menu content to the display responsive to the detection of the data signals associated with gaming device idle time and the receipt of a menu actuation signal, wherein the menu actuation signal is generated upon the detection of a touch event occurring at the preset position of the object.

In some embodiments, the object is transparently displayed. The method may also include printing a ticket upon receiving a corresponding ticket printing signal during the transmission of menu content.

The method may further include receiving player identification information for identifying the player in a loyalty program and displaying a real-time notification of player loyalty award points on the touch screen display. In some embodiments, the method may include receiving player identification information for identifying the player in a loyalty program and displaying a real-time notification of the amount of additional player loyalty award points necessary to receive a bonus on the touch screen display.

BRIEF DESCRIPTION OF THE DRAWINGS

FIG. 2 illustrates an exemplary process for the operation of a system according to some embodiments of the invention;

FIG. 3 illustrates an alternative exemplary process for the operation of a device according to some embodiments of the invention;

DETAILED DESCRIPTION OF INVENTION

Figure 1:
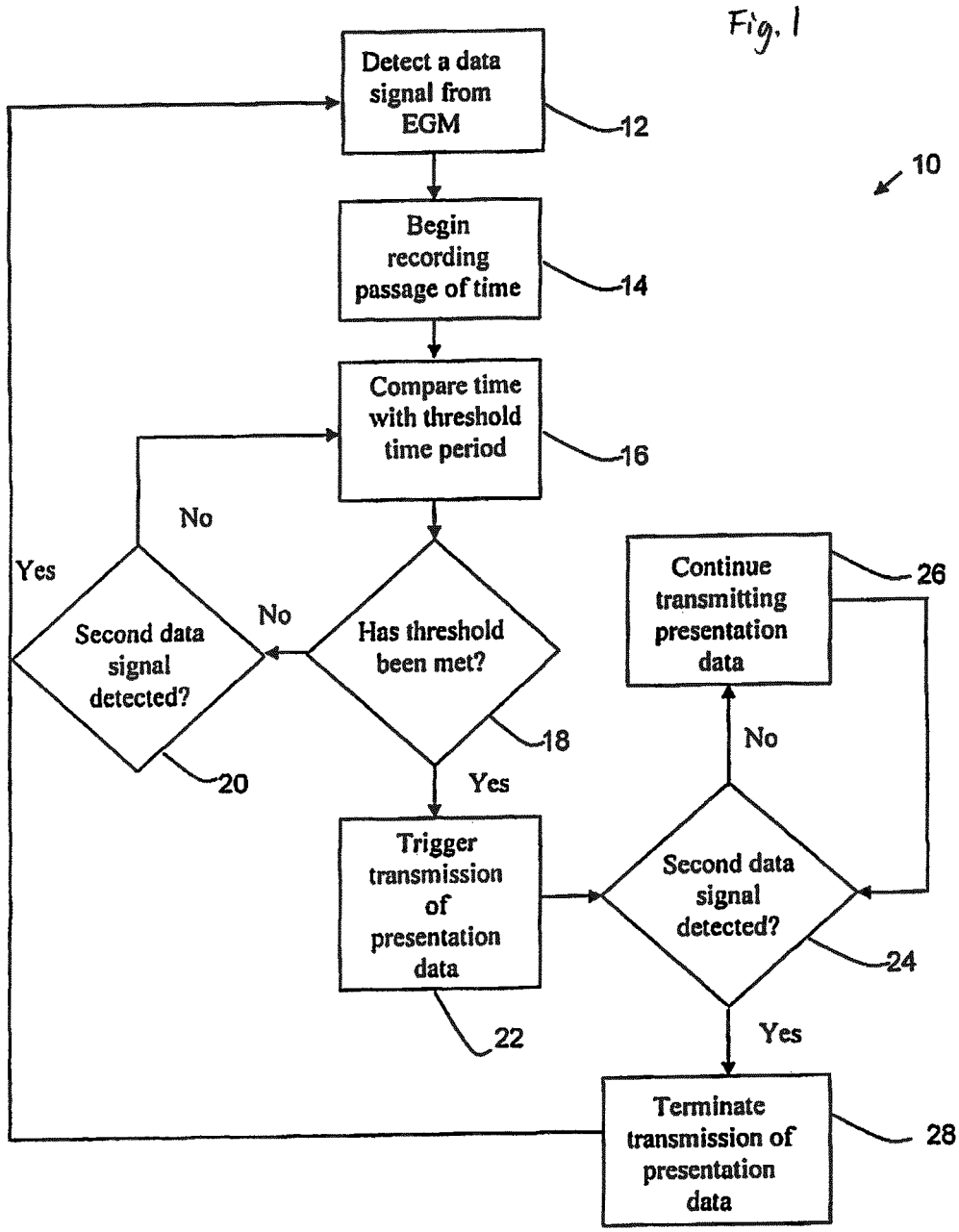
FIG. 1 illustrates an exemplary process for the operation of a device according to some embodiments of the invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the embodiments of the present invention is thereby intended. Any alterations and further modifications of the inventive feature illustrated herein, and any additional applications of the principles of the embodiments of the present invention as illustrated herein, which would normally occur to one skilled in the relevant art and having possession of this disclosure, are to be considered within the scope of the present invention as claimed.

FIG. 1 illustrates an exemplary process for the operation of a device according to the embodiments of the present invention which is generally referred to by the reference number 10. In step 12, a data signal from the EGM is detected by the marketing device. It should be understood that the terms used herein, such as marketing device or customer relationship management system, are largely interchangeable and are used for convenience sake and not to be considered in any way as limiting of the features and functionality of those systems or devices. The detection begins a timer in step 14 which monitors the passage of time from the moment the data signal was first detected. The monitored time is compared with a preset threshold time period value in step 16. If in step 18, the threshold has not been met, and a second data signal is not detected in step 20, the method returns to step 16 and continues to compare the passage of time with the threshold value. If a second data signal is detected in step 20, it is assumed that the EGM is active and in use by a user and the method starts over in step 12.

Upon the monitored time period reaching the threshold value in step 18, the transmission of presentation data is triggered in step 22. As discussed above, the presentation data preempts the video data being provided to the EGM by the EGM control board and the presentation data is shown on the EGM display. If a second data signal is not detected, the transmission of presentation data continues, as shown in steps 24 and 26. However, if a second data signal is detected, the transmission of presentation is terminated, ceasing the preemption of video data so that the EGM display once again shows the video data as it had prior to the preemption by the presentation data, and the method restarts its detection of data signals at step 12.

FIG. 2 illustrates another exemplary process for the operation of a system according to the embodiments of the invention which is generally referred to by the reference number 50. In this embodiment, system 50 is in communication with one or more sources, such as components within the EGM which would exhibit changes or conditions that are associated with either gaming machine activity or gaming machine inactivity (i.e., the gaming machine is in an active state, as in being played, or inactive state), for the purpose of passively monitoring those conditions. In step 52, system 50 detects conditions within the EGM. In step 54, system 50 determines whether the detected conditions indicate EGM activity or inactivity.

In some embodiments, system 50 may determine whether the detected conditions indicate EGM activity or inactivity based on a comparison with preset parameters that are associated with either EGM activity or inactivity, such as for example, a voltage change or the characteristics of a data signal generated by one or more sources. Thus, if a condition associated with a preset parameter is detected, then system 50 would recognize whether the condition is associated with EGM activity or inactivity.

If it is determined that the EGM is not active, and marketing content is not already being transmitted, as shown by steps 56 and 58, then system 50 will begin to record the passage of time in step 60. As shown by step 62, the passage of time will be compared with a preset time threshold. If the threshold has been met in step 64, then in step 66 system 50 will transmit marketing content to the display.

In some embodiments the marketing content is transmitted to the display via a video switch which is configured to favor the marketing content transmission over any pre-existing EGM inactivity display content.

If the time threshold has not been met, then as shown by step 64, system 50 continues to detect conditions, determine whether the detected conditions are associated with either EGM activity or inactivity, and record the passage of time in steps 52, 54, 56 and 60, respectively, if it is determined that the EGM is inactive. Thus, the transmission of marketing content in step 66 will not occur until the time threshold is met while the EGM is inactive. Likewise, the transmission of marketing content, once begun, will continue as shown particularly by steps 58 and 68 so long as the EGM remains inactive.

If it is determined that the EGM is active in step 56, then as shown in steps 70 and 72 the transmission of marketing content will discontinue and system 50 returns to detecting conditions in step 52. Also, as shown in steps 56 and 70, if it is determined that the EGM is active prior to meeting the time threshold in step 64 or before the transmission of marketing content in step 66, then system 50 returns to detecting conditions in step 52.

In other embodiments, the time period may be preset in the system according to the last activity associated with the EGM prior to the EGM becoming inactive. For example, if the EGM has just finished being serviced, the time threshold in step 64 may be increased or decreased. Alternatively, the system may require the meeting of a second time threshold in addition to the time threshold in step 64, based on the last activity associated with the EGM prior to the EGM becoming inactive.

In alternative embodiments, the transmission of marketing content may be paused at intervals, such as between the end of one advertisement, presentation or program included in the marketing content and prior to the start of another advertisement, presentation or program included in the marketing content. During the pause in the transmission of marketing content, the EGM may display the existing EGM inactivity content, which may consist of simulated game play, for example. In such embodiments, the transmission of marketing content may continue upon the passage of a second time period, that is, the meeting of a second time threshold. The second time period may be the same or different from the initial time threshold which had been met in step 64 prior to the start of the transmission of marketing content. Alternatively, the transmission of marketing content may not be paused, but rather, simulate a pause and display information regarding the game, EGM, marketing content and/or indicate on the display that the game is available for play by presenting the appropriate text, such as "press any button or insert money to play game." In some embodiments, similar text, graphics or other information may be presented on the display during the transmission of marketing content.

FIG. 3 illustrates an alternative exemplary process for the operation of a device according to the embodiments of the present invention, generally referred to by the reference number 110. In this embodiment, the device is configured to detect a signal that the EGM is entering an idle mode. An EGM idle signal may be generated after the passage of a preset period of time from when a game session on the EGM closes. Typically, a game session closes when a player session runs without play for one minute which results in End Game. For example, the preset time period may be one minute. If a player card is left or abandoned in the machine after a game session closes, the EGM idle signal may be generated after the passage of a longer period of time from when the game session closes, such as two minutes. The period of time for the EGM to generate an idle signal may vary, and may depend on the specific event causing the game session to close.

It should be understood that the idle signal may comprise any signal or plurality of signals which indicate the EGM is inactive, that is, no longer being played by a player. In some embodiments, the idle signal may comprise "keep alive" signals or other standard periodic connection check generated by the EGM. Thus, so long as the idle signals are detected, the transmission continues. However, should there be a signal detected that indicates either the EGM is active or a peripheral that does not generate a signal has been actuated, such as a touchscreen, the transmission ceases and the normal EGM display returns.

In this embodiment, an open game session in step 112 closes and the system begins recording time in step 114. As mentioned above, the threshold time period may vary depending on the event that closes the game session. Thus, the passage of time is compared with the appropriate preset threshold in step 116. In step 118, if the threshold has not been met and a data signal indicating a new game session is open is not detected in step 120, the method returns to step 116 and continues to compare the passage of time with the threshold value. If a new game session signal is detected in step 120, the EGM is active and in use by a user and the method starts over in step 112 until this new game session closes.

Once the monitored time period reaches the threshold value in step 118, the EGM goes into idle mode and an idle signal is generated by the EGM in step 130 which may also be detected in step 132. If the idle signal is not detected in step 132, the method returns to step 120 to determine whether a new game session has opened. If the idle signal is detected in step 132 then the transmission of presentation data begins in step 122. As discussed above, the presentation data preempts the video data being provided to the EGM by the EGM control board and the presentation data is shown on the EGM display. If a game session is not opened, the presentation data continues to be supplied to the EGM display, as shown in steps 124 and 126. However, if a new game session signal is detected, the transmission of presentation is terminated, ceasing the preemption of video data so that the EGM display once again shows the video data as it had prior to the preemption by the presentation data, thus allowing the game session to be played by the player, as shown in step 112.

In one embodiment, a system of the embodiments of the present invention may include the components such as an interface board capable of instantly switching between an EGM video source and a secondary source of presentation or video data. The interface board may be configured with memory, processing devices, operating systems, communication devices and other hardware or software as necessary. The secondary video source may be an outside server or videos stored within the memory on the interface board.

The board may include a connection with the EGM for monitoring for the presence of game idle and game active signals, such as SAS protocol signals generated during EGM events. While the game is active, the EGM game video is played on the display. Upon detection of a game idle signal, the interface board switches video sources from the EGM video source to the secondary video source. The interface board is configured to decode or play videos from the secondary video source on the EGM display. Upon detection of a game active signal, the interface board switches video sources to the EGM video source and the playing of the video from the secondary video source is stopped. The memory may record the particular video played, how long it played or if it finished, the time and date for each video played, amount of times each video played, or other pertinent statistics or data relating to the provision of videos to the EGM display according to the embodiments of the present invention.

The switching of video sources may be accomplished by a physical hardware connection with the EGM game video source and/or secondary video source or through software.

In one embodiment, video data is provided to the memory on the interface board through a periodic download from a video server. The downloading of data may be facilitated by wireless or wired connection. It is envisioned that the interface board will maintain a completely separate connection for transceiving data than the EGM. Thus, if a wired connection is used, it may be completely independent of the EGM connection with the central computer system used by the casino or gaming establishment, and may conform to applicable cabling standards.

In this embodiment, the video server may be connected with a plurality of interface boards, each being operatively associated with one or more EGMs. The video server may manage and control the provision of videos to the video displays through each interface board. It may also provide video data to each memory, remove video data, provide updates, or retrieve statistics relating to the provision of videos via the interface board. This information may be collected from each interface board, saved in a video server database and presented to casinos and ad agencies for accounting and billing purposes via a user-accessible webpage or other reporting method.

Figure 4:
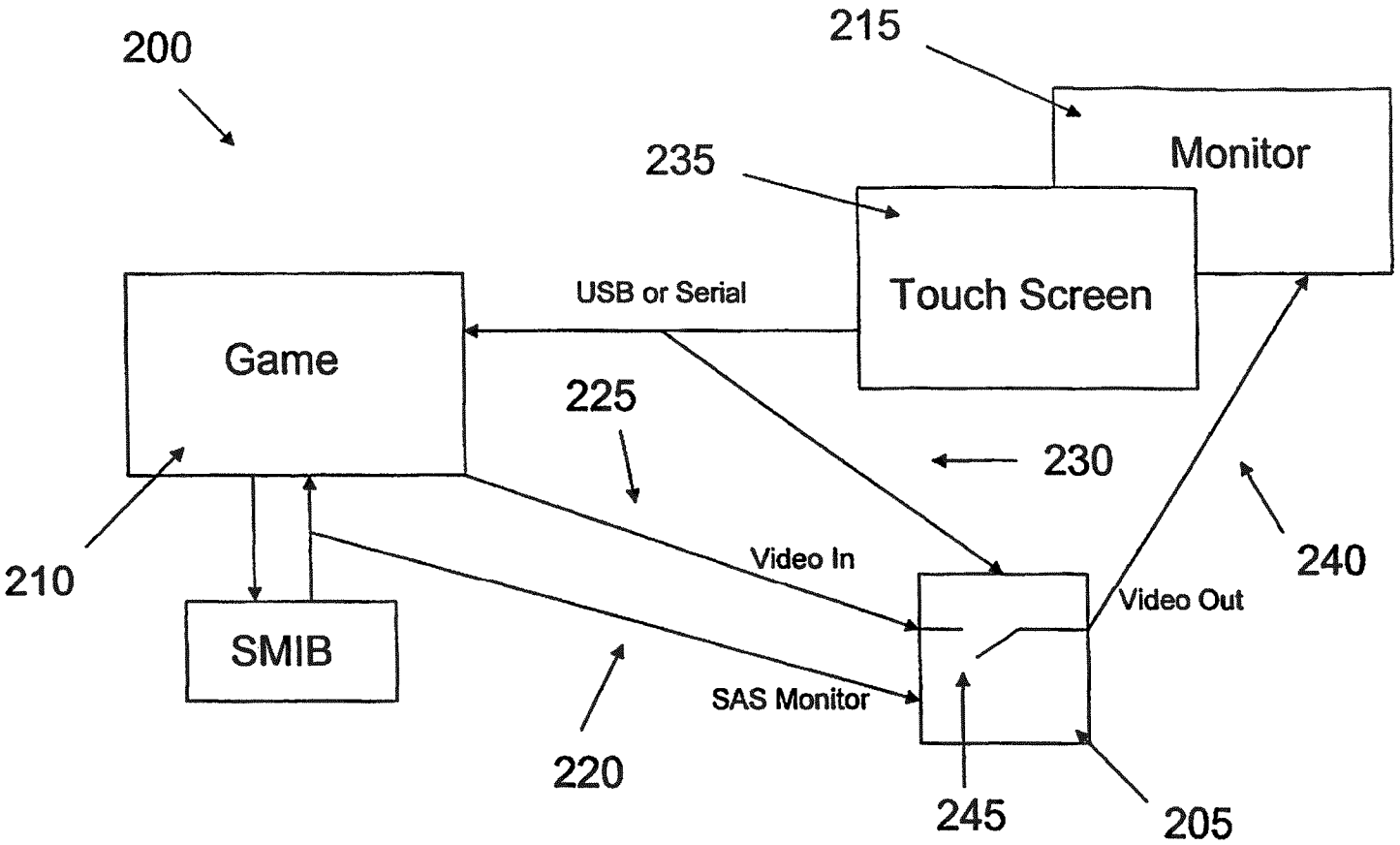
FIG. 4 illustrates an exemplary block diagram of one system architecture according to some embodiments of the invention.

FIG. 4 illustrates an exemplary block diagram of one system architecture according to the embodiments of the present invention generally referred to by reference numeral 200. System 200 includes, among other things, a single board computer 205 with three inputs from the electronic gaming machine 210 and one output to the monitor 215. The three inputs include the SAS monitor cable 220, video in cable 225 and USB or serial monitor cable 230. The SAS monitor cable 220 allows the single board computer 205 to monitor SAS traffic (i.e., data packets) from the electronic game machine 210 to the host thereby allowing the computer 205 to determine when the electronic gaming machine 210 is in use despite the touch screen 235 not being used (e.g., physical buttons being used).

In some embodiments, a board computer such as board computer 205 is in communication with one or more components of electronic gaming machine 210, such as the touch screen, ticket printer, SMIB, one or more button lamps, one or more indicator lamps or "candles" or other components associated with electronic gaming machine 210, for receiving information or passively detecting changes associated with either game idle or game active states, such as current changes, voltage changes, data transmissions relating to such components or other change of conditions.

For example, in some embodiments, computer 205 is configured to determine by monitoring the lamp voltages in the top candle, bottom candle and cash out button, that the electronic gaming machine 210 is in a condition associated with being in use, such as for example, having player credits thereon, being in tilt mode, waiting on a hand pay or jackpot delivery, has an open door, or the service light has been pressed. In some embodiments, if any such conditions are detected, marketing content will not be displayed until a preset delay time period has passed from when the condition is cleared, that is, the point at which the condition is no longer detected by the system.

System 200 may include preset detection parameters, that is, it may be configured to associate certain conditions with the gaming machine being in use. It should be readily apparent that these preset detection parameters may be changed to include other detectable conditions to be associated with game activity, or certain detectable conditions may be excluded as not being associated with game activity, as necessary depending on the configuration of the particular gaming machine or to achieve the desired results.

In one embodiment, the USB host controller (i.e., the game) polls the touch screen 235 every millisecond to determine if any touch screen activity exists. In some embodiments, when the touch screen controller reports a touch, the USB host controller polls more frequently. The USB or serial monitor cable 215 allow the single board computer 205 to determine when the touch screen 235 of the electronic gaming machine 210 is in use. The USB or serial monitor cable 215 inputs into a general-purpose input pin on the single board computer 205. The video in cable 225 diverts normal game video through the single board computer while video out cable 240 diverts the normal game video to the monitor 215. The video in cable 225 comprises a VGA (analog or digital) cable from the electronic gaming machine 210 to a VGA-IN port of the computer 205. The video out cable 240 comprises a VGA cable plugged into a VGA-OUT port of the computer 205 and leading to the monitor 215. Responsive to the inputs generated by the SAS monitor cable 220 and USB or serial monitor cable 230, a video switch 245 opens and closes as set forth above to direct the proper video to the monitor 215.

Figure 5:
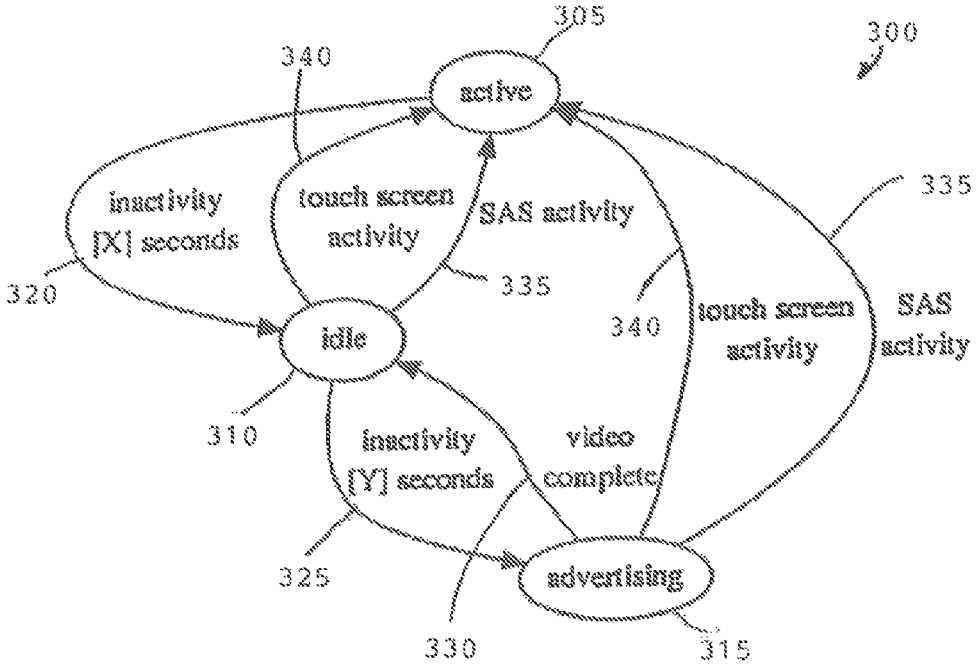
FIG. 5 illustrates a diagram of one system failure model according to some embodiments of the invention.

FIG. 5 provides a diagram of a system failure prevention model 300 according to some embodiments of the present invention. The model 300 details features designed to reduce the probability of failure while the computer 205 has control of the monitor 215 (i.e., sending advertisements to monitor 215). There are three states comprising active 305, idle 310 and advertising 315. The system is in the active state while gaming activities take place on the electronic gaming machine. The system remains in the active state 305 until a pre-established time of inactivity 320 (designated as [X] seconds in model 300). Once the pre-established time of inactivity passes, the system moves into the idle state 310 and toggles between the idle state 310 and advertising state 315, playing a single video or still advertisement until completion 330, then waiting for [Y] seconds of inactivity 325 before deciding to return to the active state 305 or advertising state 315. The video output is only connected to the monitor 215 when the advertisement is playing. Any activity on either the SAS interface 335 or touch screen interface 340 causes a transition to the active state 305 from the idle state 310 or advertising state 315.

In some embodiments, board computer 205 is configured for determining information relating to the characteristics of the normal game video data stream passing through the ports associated therewith, such as display resolution or pixels information, and automatically adjusting the characteristics of the marketing or advertising content to match the characteristics of the normal game video data stream accordingly.

In one embodiment, the system activates the video output only after preparing the advertisement for playback, and deactivates the video before cleaning up after each advertisement to minimize the chances of failure while the game output is not being displayed.

In some embodiments, the system provides a virtual button or other graphical representation as part of the display of marketing content on the EGM display which indicates that the game may be played (and marketing content halted) by touching the touch screen or pressing a button on the EGM. In some embodiments, the display of marketing content may also include a scroll bar or other display of information, such as news, a stock ticker or information regarding gaming tournaments or other local events.

Figure 6:
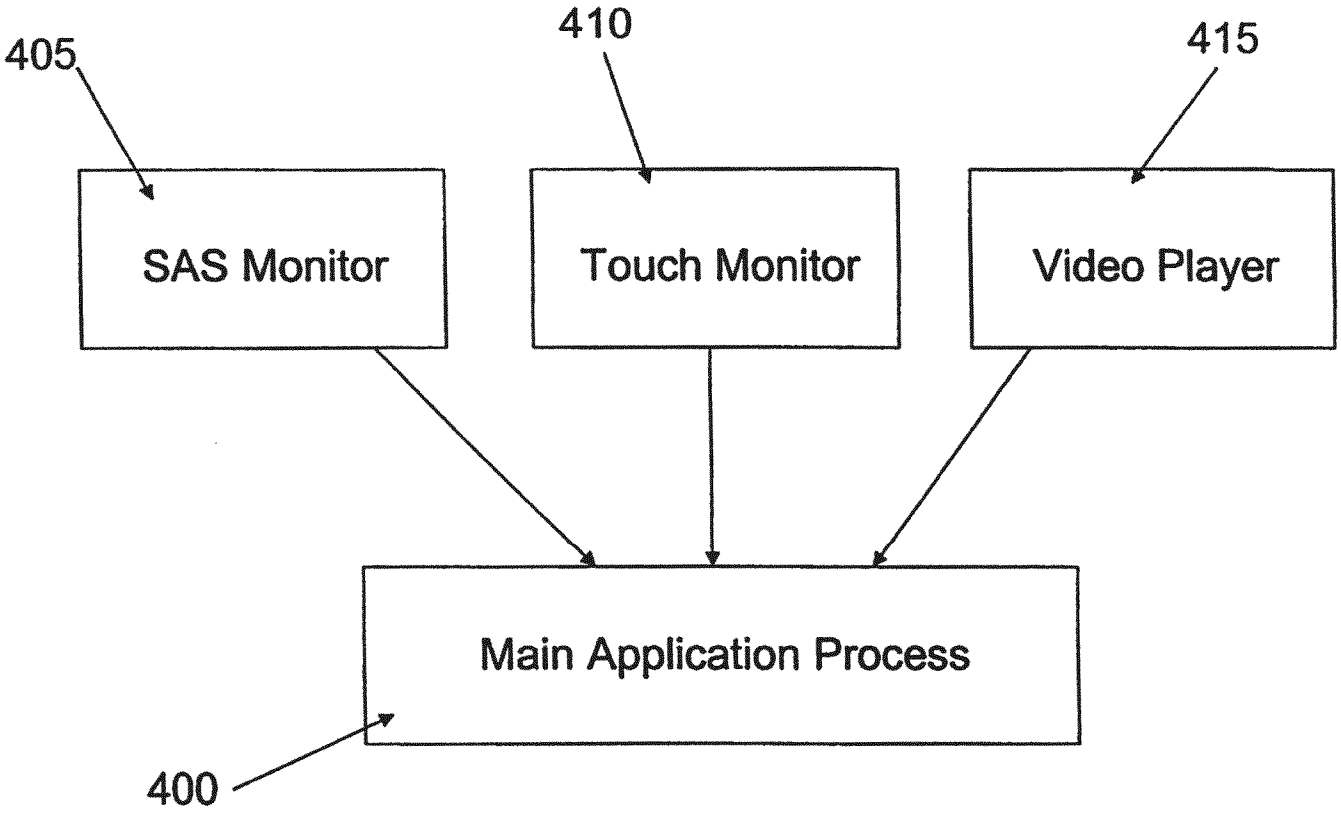
FIG. 6 illustrates a diagram of one process architecture according to some embodiments of the invention.

In one embodiment, in order to limit the exposure to endless loops or other forms of software lock-ups, the system's main application process 400, as facilitated by the computer 205 and shown in FIG. 6, is broken into multiple processes comprising a SAS monitor application 405, touch screen monitor application 410 and video player application 415. When in the active state 305 or idle state 310, the primary application process 400, has two sub-processes comprising the SAS monitor application 405 and touch screen monitor application 410. In one embodiment, the SAS monitor application 405 and touch screen monitor application 410 are each connected to the main application process 400 via a pair UNIX pipes, or other framework for receiving an input stream of information and modifying that input stream for subsequent communication as an output stream, which notify the main application process 400 that there is activity on the electronic gaming machine and the sub-processes are alive. So, the main application process 400 considers the game active if either sub-process notify the main process application 400 that the game is active or if either sub-process does not indicate that it is alive within a customizable time period. If the sub-processes do not notify the main application process 400 that the game is active and the sub-processes are alive, the main application process 400 enters the advertising state 315. Responsive to the video player application 415 beginning, the main application process 400 connects its video output by means of video switch 245 to the monitor 215. When the playback is complete, if SAS or touch screen activity is detected, or if any error is detected, the main application process connects the electronic gaming machine's video to the monitor 215 by means of video switch 245 before transitioning to either the active state 305 or idle state 310.

In some embodiments, a marketing device 500 such as those described herein may transmit presentation data to be displayed on touch screen display device during game idle times, and is in communication with the EGM to receive data either generated by the touch screen display device or relating to the operation of a touch screen display device thereof. This touch screen operation data is analyzed by marketing device 500 to determine whether a touch event has occurred, that is, whether a player has physically touched the screen. The data further includes information which is analyzed by marketing device 500 to determine the relative location on the touch screen display at which the touch event occurred, that is, approximately where the touch screen was touched by the player. Marketing device 500 may also use the information to determine the time at which the touch event occurred.

Marketing device 500 is also configured to display static or dynamic visual representations of distinct objects along with or overlaying the presentation data at predefined areas on the touch screen display at either predefined time intervals or during the entire display of a singular presentation or advertisement associated with the presentation data. Marketing device 500 correlates the location of the touch event and/or time at which the touch event occurred with the predefined areas and/or time intervals for the distinct objects to determine whether the touch event occurred on a distinct object. Each distinct object may be operatively associated by marketing device with a preset action or response. These actions may include a variety of operations, such as for example, contacting service staff or other personnel, sending a message, displaying player loyalty information, etc. In some embodiments, objects may be operatively associated with providing something to the player, such as a paper ticket, coupon, smart card or other media, via a dispenser which may be associated with the EGM.

Figure 7:
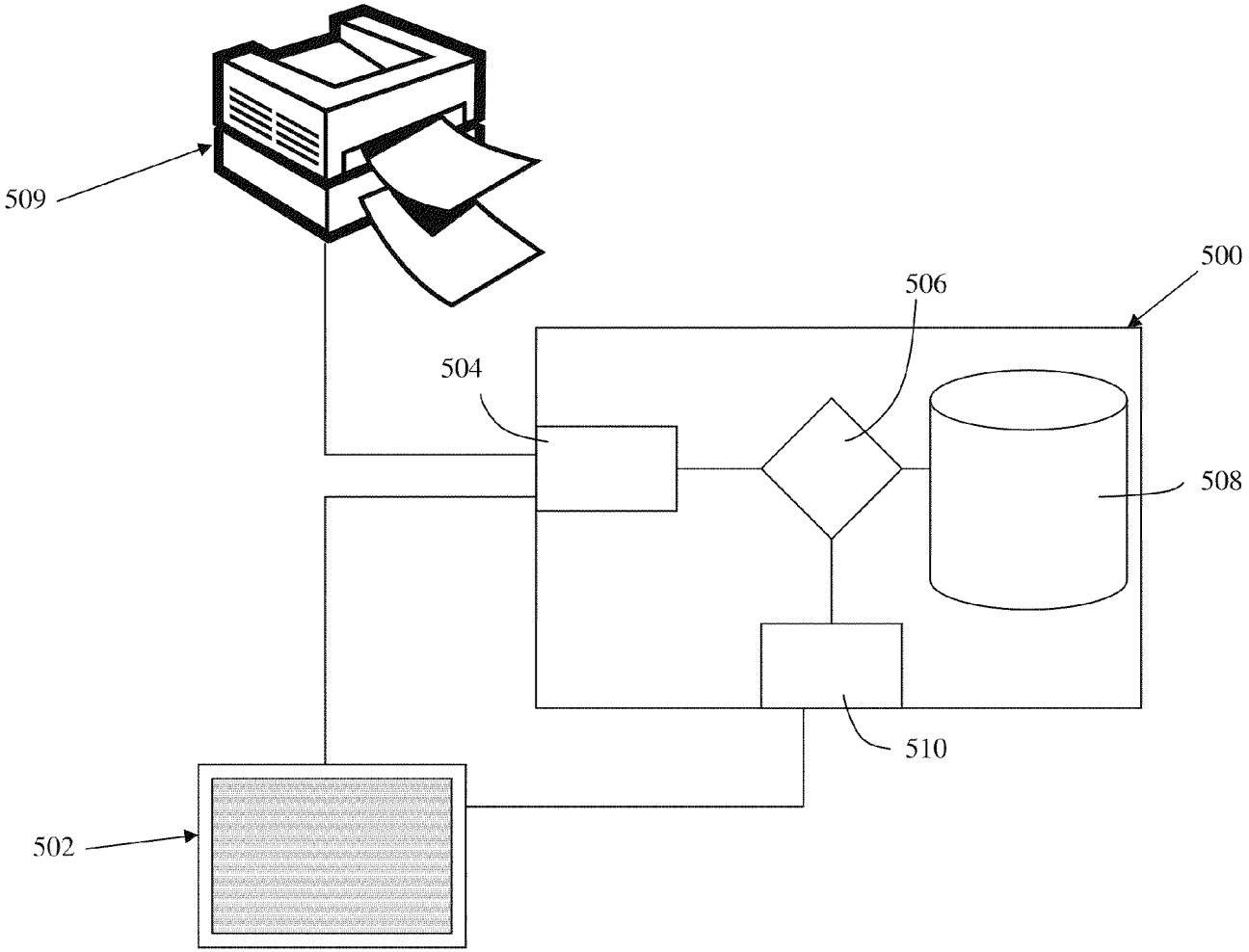
FIG. 7 is a schematic illustrating the various components of a device constructed in accordance with some embodiments of the invention.

In an exemplary embodiment shown schematically in FIG. 7, marketing device 500 is either configured with an EGM or added to an existing EGM with a touch screen display device 502. Marketing device 500 includes a data input port 504 for receiving EGM-related data such as touch screen display device data from touch screen display device 502. Marketing device 500 further includes a data processor 506, a database or memory 508 and multimedia or video input/output port 510.

Under normal operating conditions, EGM game content bypasses port 510 to be displayed on touch screen display device 502. Data input/output port 504 is configured for receiving data from the EGM that enables marketing device 500 to determine that the EGM is in idle mode via data processor 506 and one or more programs stored in memory 508. The data output functions of port 504 are used to transmit data from marketing device 500. Marketing device 500, via programs stored in memory 508, is configured to transmit presentation data from memory 508 or other source to port 510 in order to preempt the usual EGM content transmitted to touch screen device 502 in favor of displaying the presentation data.

In this embodiment, the presentation data from memory 508 also includes information relating to one or more representations of objects for display on the touch screen display device 502 during the presentation data, which is also transmitted to touch screen display device 502 via port 510. Memory 508 includes a list of the objects and the predefined areas upon which each object is to be displayed. In some embodiments, the touch screen display device 502 is characterized by marketing device 500 as a grid defining an x-axis and a y-axis thereon for purposes of displaying presentation data and or representations of objects. Thus, the predefined areas may be set forth on the grid by sets of x-axis and y-axis coordinates stored in memory 508, and displayed accordingly on touch screen display device 502. It should be readily apparent that display 502 and grid may be of varying shapes and sizes. The areas in which the objects shown on touch screen display device 502 are stored along with an executable action in memory 508 which may be carried out via processor 506 and communicated through data input/output port 504. For example, the executable action in memory 508 may be an instruction to print a ticket with particular indicia thereon via ticket printer device 509 installed in the EGM.

Figure 8:
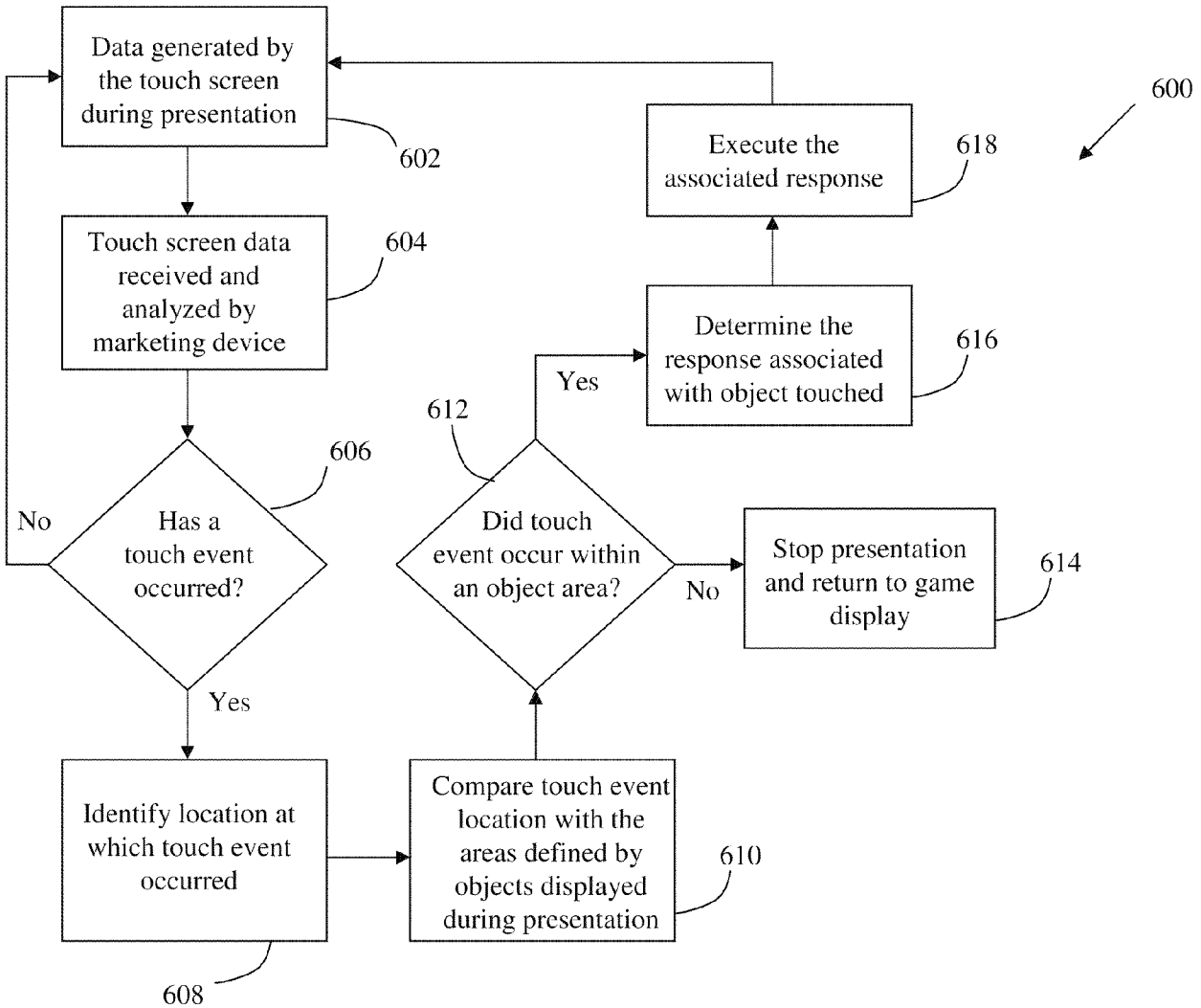
FIG. 8 is a flow diagram illustrating an exemplary process for the operation of a device according to some embodiments of the invention.

FIG. 8 illustrates an exemplary method of operation 600 which will be described in combination with marketing device 500 for purposes of illustrating the features of some embodiments of the invention. Method 600 presumes that an idle mode has been detected and presentation data is being transmitted to touch screen display device 502 along with one or more objects displayed in predefined areas of touch screen display device 502. As shown in step 602, data is continually generated by touch screen device 502, among other components in an EGM, during both normal operation and while presentation data is being displayed thereon. As shown in step 604, the touch screen data is received in data input/output port 504 of marketing device 500 during the presentation.

In step 606, the touch screen data is analyzed with the assistance of processor 506 and applicable programs stored in memory 508 to determine whether the data indicates that a player has touched the screen (i.e., a touch event has occurred). If it is determined that a touch event has not occurred, then marketing device continues to returns to receiving and analyzing data as set forth in the previous steps 602 and 604.

If a touch event has occurred, then marketing device 500 determines the location on touch screen display 502 at which the touch event occurred via processor 506 and applicable programs stored in memory 508 as shown by step 608. The touch event location information is compared with the areas in which objects are displayed on touch screen device 502 in step 610. If in step 612 it is determined that the touch event location was not within an object display area, then the presentation is stopped and the normal game display is permitted to resume as shown in step 614.

If in step 612 it is determined that the touch event location was within an object display area, then marketing device 500 determines the response associated with the "touched" object in step 616. Marketing device 500 either directly executes or facilitates execution of the associated response in step 618 before returning to receiving and analyzing touch screen data in steps 602 and 604.

Figure 9:
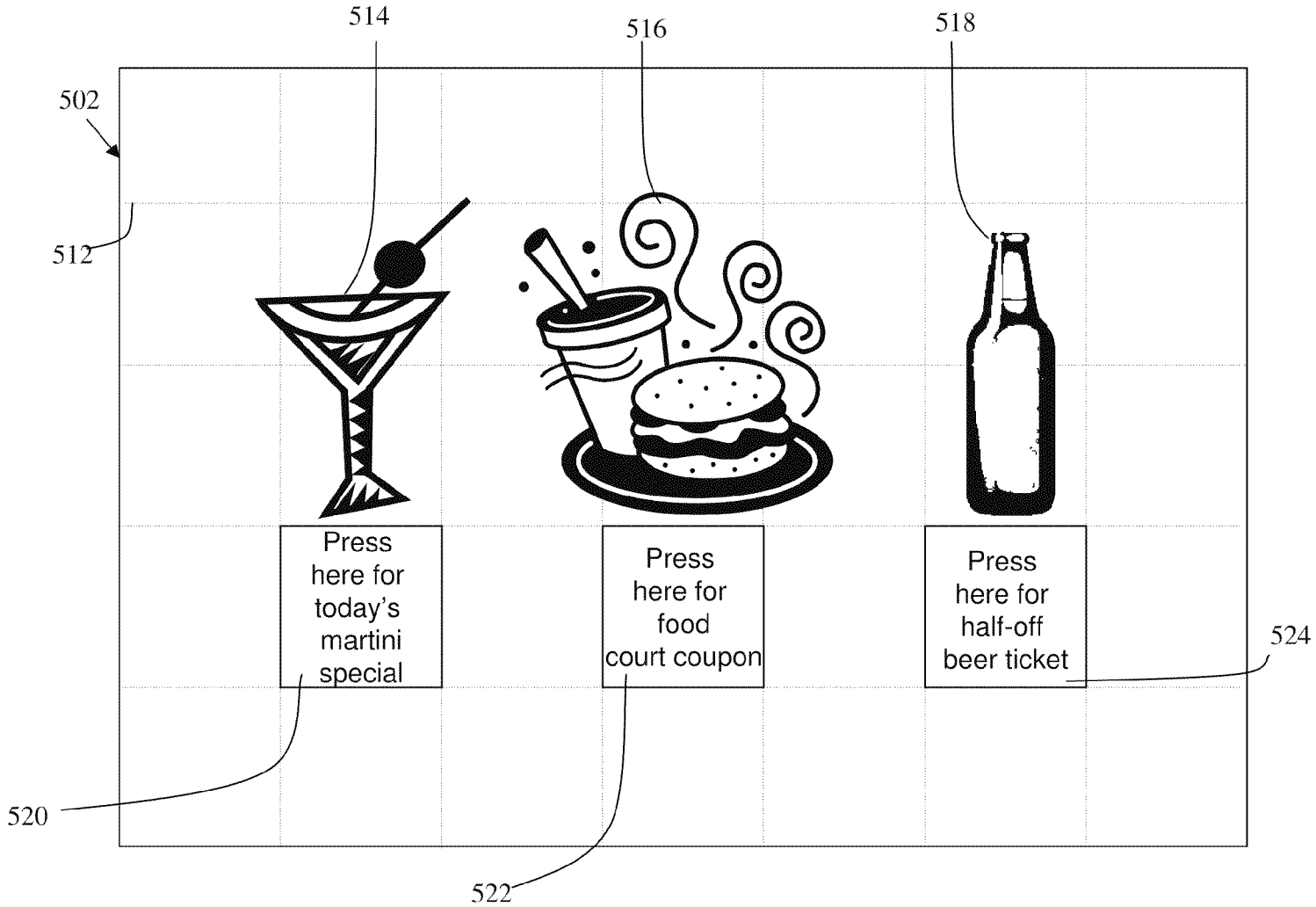
FIG. 9 is a schematic representation of a touch screen display illustrating the display of presentation data and executable buttons according to some embodiments of the invention.

FIG. 9 illustrates an example of a touch screen display 502 divided into a grid 512, which would not be displayed to players but is illustrated herein for purposes of discussing the embodiment. Presentation data transmitted to touch screen device 502 includes a visual representation of a martini 514, hamburger and drink 516 and a beer 518. These visual representations may be defined on grid 512 along with corresponding objects, which in this example are virtual representations of depressible buttons 520, 522 and 524. In this embodiment, if the area of displayed button 520 is touched by a player, then a ticket will be dispensed that may be used by the player to obtain a discount on the purchase of a type of martini at the gaming establishment. Thus, button 520 is associated in memory 508 with the transmission of a signal from data input/output port 504 which provides instructions to the EGMs on-board ticket printing device (which is commonly used in cashless wagering systems) to print a ticket, including the graphics and indicia. Similarly, the associations in memory 508 are set so that touching button 522 will cause a ticket to print out which may be redeemed by the player for a discount on the purchase of food in the food court of a gaming establishment and touching button 524 will cause a ticket to be printed that may be redeemed by the player for a discount ("half-off") on a beer purchase.

Figure 10:
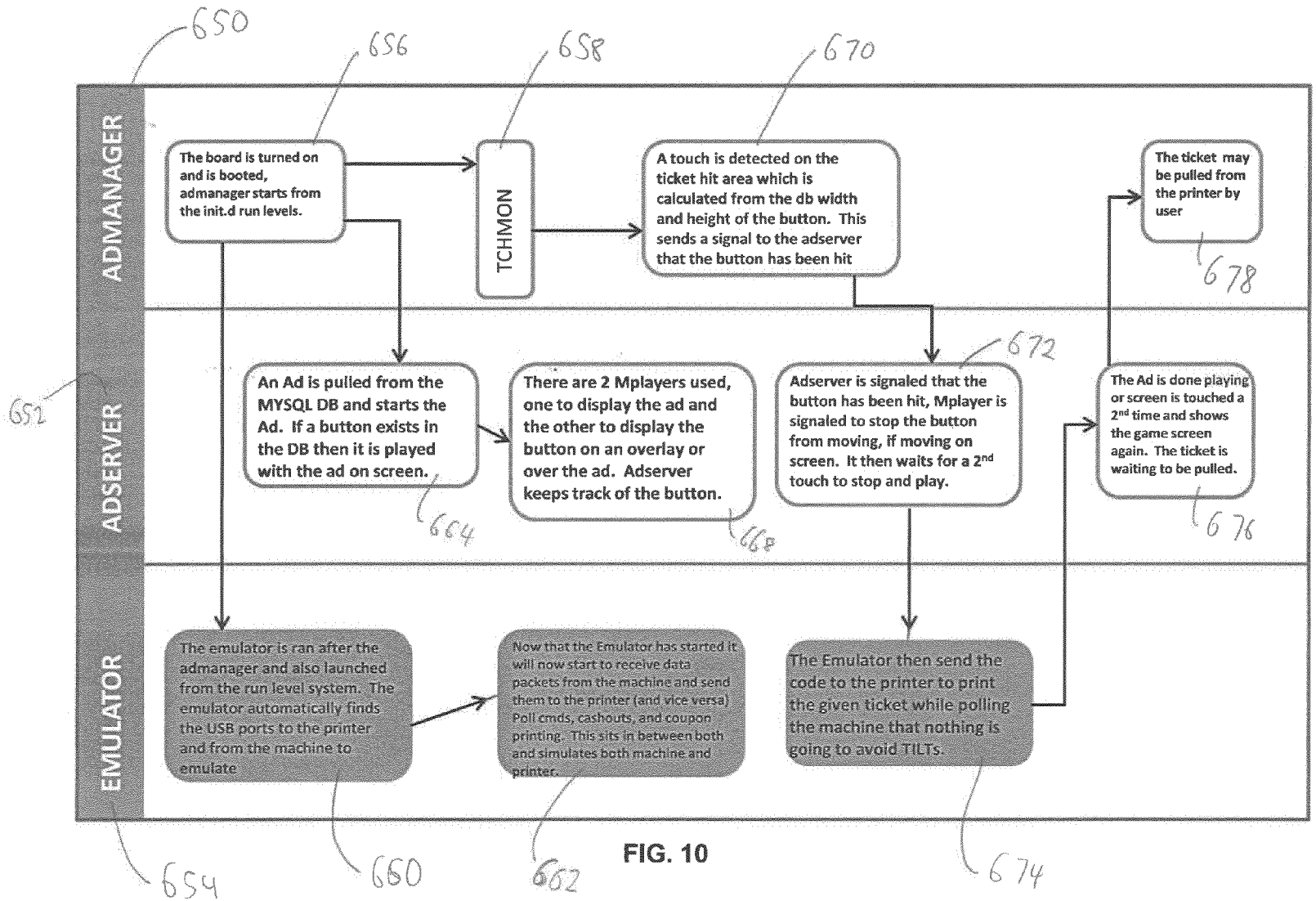
FIG. 10 is an exemplary illustration intended to facilitate discussion of the software and hardware interaction and functionality of some embodiments of the invention, and illustrates some of the binary programs and interactions of software and hardware, among other things.

In some embodiments, exemplary programs stored in memory 508 of marketing device 500 are shown in FIG. 10 and referred to herein as Admanager 650, Adserver 652 and Emulator 654 for non-limiting, descriptive purposes. Admanager 650 handles functions relating to the monitoring of the EGM touch screen display device (TCHMON), including determining whether a touch event has occurred within the area defined by the displayed object or button and sending a signal to the Adserver 652 regarding the button which has been touched by the player.

Adserver 652 provides presentation data or ads from a database and transmits the ads for display on the touch screen device. Adserver 652 also transmits the button information for display along with the ad and manages the executable instructions relating to each button. In some embodiments, Adserver 652 may utilize a software media player for displaying the ad and a separate software media player for displaying the executable button on the touch screen device.

Emulator 654 determines the necessary ports relating to the EGM and printer in order to be able to communicate with the printer in the same fashion as the EGM. Emulator 654 is also configured to receive data generated between the EGM and printer relating to normal operations, such as cashless wagering or routine polling signals, without interacting with such communication.

As shown by 656, the circuit board, which may be made by Intel or other circuit board manufacturer, is turned on and booted, admanager 650 begins the initial launch routine or otherwise starts from the "init.d run" levels which may occur upon EGM inactivity being detected. This includes communication with touchscreen monitor TCHMON as shown by 658 for ultimately playing multimedia ads thereon. Emulator 654 is also launched from the run level system as shown by 660 after admanager 650 is started and locates the ports to be emulated, which include the communication ports between the EGM onboard printer and other EGM components. As shown by 662, emulator 654 will begin receiving packets of data from the EGM components and send them to the printer and vice versa, such as various commands, player cashouts, coupon printing etc. Emulator 654 simulates both EGM components and printer and causes no alarm issue.

As shown by 664, an ad is obtained from the ad database by adserver 652 and playing thereof on the EGM touch screen display begins. If a visual representation of a button is to be displayed then it will be presented on the touch screen along with the ad. As shown by 668, the ad may be played on the touch screen by one or more multimedia or movie players while one or more buttons may be presented on an overlay by additional media players. In this embodiment, the button may indicate that a ticket will be printed upon actuation thereof.

As shown by 670, when a touch is detected on the button area which is calculated from the width and height of the button, admanager 650 transmits a corresponding signal to adserver 652 to indicate the same. As shown by 672, adserver 652 is alerted to the touch event on the button and the media player responsible for the button holds the button in place as presented on the EGM display. In this embodiment, the ad will continue until a second touch event is detected. As shown by 674, emulator 654 transmits the appropriate code to the EGM printer to print the ticket corresponding to the button while polling the EGM or otherwise ensuring that an alarm or tilt state does not occur. As shown by 676, when the ad is finished playing or a second touch event is detected, the underlying EGM inactive game screen is shown on the EGM display again and printed ticket awaits removal as shown by 678.

In some embodiments, Admanager notifies Adserver when a displayed button has been touched by a player during presentation of an ad with a button on touch screen device as transmitted by Adserver. In some embodiments, Adserver responses to the notification that a button has been touched by halting further transmission of display data relating to that button from the separate media player, if any. Thus, the button will appear to freeze in place on the touch screen. Adserver sends instructions via Emulator to the printer on the EGM regarding the appropriate ticket to be printed, while Emulator also communicates with the EGM components so that it may operate the EGM printer without causing an internal alarm condition or "tilt." After the ticket has been printed, Adserver continues the display of the ad until the touch screen is either touched again (presumably in an area outside of a button) or the ad is finished and the EGM content is displayed again on the touch screen.

In some embodiments, a marketing device such as marketing device 500 is in communication with a player tracking or player promotional system. In some embodiments, the marketing device is configured to be responsive to a touch event only if a player identifies themselves as having a player account or listing in the promotional system associated with the gaming establishment. In some embodiments, the marketing device is configured to notify or display a message on the EGM display screen indicating that the player must first insert a player card of otherwise identify themselves prior to executing the associated response in memory, such as printing a coupon or crediting the player account electronically, which may be at any time, such as after receiving a touch event in an object area or along with the presentation data without being triggered by a touch event. In such embodiments, the marketing device may be used to obtain and record a variety of data about each player, which may be maintained in connection with the identified player in the player tracking system or other memory. The data may include information relating to the time of the touch event, the type of EGM or game at which the touch event occurred, the nature of buttons or objects each player touches or otherwise expresses interest in, and the number of times the player has made use of the marketing device of the invention. Some embodiments may also be configured to keep a tally or record of the buttons pressed and coupons delivered for each player in order to perform a check prior to subsequent execution or coupon delivery for purposes of limiting the amount of responses or coupons to be made available to each player, among other things.

Systems and methods of the invention further provide various functionalities which include facilitating patron services through communication with EGM components as described above and herein below. In some embodiments, a system and method according to the invention is configured to utilize the EGM display screen hardware as a player/operator interface as a means of communication.

In some embodiments, the systems and methods are configured to provide real-time notification to wagering game players of an anticipated reward, wherein the awarding of the reward is based on satisfying criteria largely independent of the game outcome, thus providing added incentive for the player to continue playing the wagering game to achieve the award.

Some embodiments of the invention are directed to systems, devices and methods for rewarding player loyalty and providing incentives for players to continue playing a wagering game by notifying a player that a bonus game play reward which will be awarded to the player independently of the outcome in the underlying wagering game, but wherein the awarding thereof depends on further game play of the underlying wagering game. By the term "bonus" it is meant an award, reward or the like. The bonus may have a variety of forms, including money, prizes such as tangible goods or free or reduced price goods or services, or points or other representative elements (tangible or intangible) which may be redeemed for goods, services and/or money.

It is noted that bonuses, such as player loyalty rewards are also referred to as "comps" because they are "complimentary" in that they do not necessarily depend on wagering outcomes or the satisfaction of specific obligations in order to be received by players. Rather, comps may be awarded to players based on the satisfaction of various criteria which is often considered a general measure of overall player interaction at the establishment over time. For example, a hotel room may be provided for free to a player as a comp in return for having played a certain number of wagering games in one day.

In some embodiments, the system and method of the invention as described above is operatively associated with an EGM in communication with a player tracking system. Generally, a player registers with the gaming establishment prior to commencing gaming. The gaming establishment issues a unique player-tracking card to the player and opens a corresponding player account that is stored in a player database in connection with the player tracking system. The player account typically includes the player's name and mailing address and perhaps other information of interest to the gaming establishment in connection with marketing efforts. Prior to playing at one of the EGMs, the player inserts their card into reader thus permitting the player tracking system to track player activity, such as amounts wagered, amounts won or lost, average wager and rate of play.

It should be understood that the player tracking system described above is a non-limiting example, and the invention may function with player tracking systems that differ as well as those which utilize other technology to identify players, such as systems which incorporate wireless identification, smart cards or RFID tags for example.

The player tracking system may comprise a single computer or a group of computers associated with one another on a network for monitoring one or more EGMs in one or more gaming establishments. Player data is obtained as players play games or otherwise interact with the gaming establishment in an identified manner so information regarding their interaction can be collected, that is, for example, by identifying themselves at the establishment with the player card. The player data is stored in connection with the player account in the player database.

In some embodiments, the invention is operatively associated with the player tracking system and configured for periodically conducting the steps of determining the aggregated player interaction data stored in the tracking system, determining reward criteria for implementing a player loyalty reward or "comp" function, comparing the aggregated player interaction data with the reward criteria to determine whether all the reward criteria has been satisfied and notifying the player of any remaining criteria that must be satisfied in order to attain a reward, or alternatively, notifying the player that a reward criteria has been satisfied, and in some embodiments, automatically assigning a reward to the player.

The invention may in some embodiments include, among other things, a data input device for receiving data from the player tracking system, such as the aggregated player interaction data, a memory device for storing data, such as the reward criteria, a processor for comparing the aggregated player interaction data with the reward criteria to determine whether all the reward criteria has been satisfied and a data output device for notifying the player notifying the player of any remaining criteria that must be satisfied in order to attain a reward, or alternatively, notifying the player that a reward criteria has been satisfied.

The player interaction data and reward criteria often rely on point-based systems in which specific interactions are correlated with one or more reward points and reward point tallies are stored by the player tracking system in connection with each identified player in the player account. Thus, the reward criteria correspond with achieving one or more reward point amounts or levels.

It should be readily apparent that a player may acquire points based upon the extent of nature of their game play at the establishment, such as amounts bet, average wager, amounts won or lost, but different player selections or interactions may be associated with different point accumulation. For example, each game played may earn a player one reward point, while wagering the maximum amount in games played may earn a player additional reward points.

In some embodiments, the data input device is in communication for receiving reward point tally data from the player tracking system. Thus, as a player accrues reward points while, for example, playing at an EGM, and those points are stored in the player account, the data input device accesses the point data periodically to receive updated point tallies. The data input device may also receive reward criteria in the form of one or more reward point amounts which entitle the player to a reward. The reward point amount may be set by the establishment and stored in a reward criteria database operatively associated with the player tracking system and in communication with the data input device. Alternatively, the reward criteria may be stored in a separate memory. It should be understood that reward criteria in the form of reward point amounts may be changed, such as for example, to encourage play during times of the day or week in which the establishment seeks increase player participation. The reward criteria may also differ for each player or groups of players having certain demographics, characteristics or exhibit behaviors which make them more desirable patrons at the establishment. Also, the reward criteria may consist of a plurality of reward point amounts associated with a corresponding hierarchal reward structure.

The processor periodically compares the reward point tally with reward criteria in the form or reward point amounts as the player accrues points and determines the difference between the tally and reward point amount, which is the reward points necessary for the player to receive a reward. In some embodiments, the player is periodically notified by the data output device of the amount of reward points necessary as they are also accruing additional reward points. Thus, they are continually updated in near real-time of the amount of points remaining until a reward will be issued.

For example, if a player has 400 points and the reward point amount is 500 points, the processor will determine that 100 points are necessary to achieve a player loyalty reward and notify the player of the same. Alternatively, the notification may be expressed as a percentage of the reward point amount, so in the example above, a player may be notified they have 80% of the points needed to receive a player loyalty reward. As reward points continue to accrue, the processor will determine the difference or the percentage, as in the examples above, and notify the player as they get closer to achieving the reward point amount.

Once a reward point amount is reached by the player, a reward may be issued to the player from a reward database operatively associated with the player tracking system. Data regarding the reward issued to the player may also be received by the data input device and the player may be notified through the data output device of the reward.

In some embodiments, the system and method of the invention is configured to notify the player via a communication between the data output device and an EGM. The notification to the player may be any audio or visual cue that notifies the player of their relative proximity to the reward point amount. In some embodiments, the notification may consist of a scrolling text message on a portion of the main display or other EGM display screen. In some embodiments, the scrolling text may include any one or more of the player's most current point tally, amount of points the player must accrue to receive a reward, the reward point amount necessary to receive a reward, and information regarding the reward available to the player based on the player's current reward points. In some embodiments, a separate notification system including a display and/or audio speakers may be operatively associated with an EGM for notifying the player according to the invention.

Thus, in the above embodiment, players will be updated of the amount of reward points necessary to receive a reward as points accumulate through their continued game play. It is envisioned that players will be further motivated to continue earning points as they are notified of how close their point tally is to a reward point amount, either through continued game play at an EGM or other player interactions with the establishment, to ultimately reach the reward point amount and receive a reward. It should be readily apparent that gaming establishments are continually seeking ways in which to please players, provide incentives and encourage additional game play and player loyalty.

In some embodiments, a player may be given the opportunity to earn bonus points if the player continues playing the game after having received a first reward or be offered the opportunity to play for a second reward by accruing sufficient reward points to reach a second reward point amount. It should be readily apparent that the period for comparing the reward point amounts and updating the player may be varied as desired by the establishment or necessitated by other factors, such as hardware or software limitations, or by order of a regulatory agency.

Some embodiments are configured to facilitate communication with players through a display of content on the display hardware. During typical operation the display screen of the EGM receives image data and presents a game-related main image display, such as a virtual representation of reel slots or playing cards, which is viewable to users. The main image display is created by a game-related video data stream provided by one or more EGM components and responsive at least in part to player interaction with the EGM. The main image display is typically centered on the display screen hardware, and may or may not result in an unused border area surrounding the main image display.

In some embodiments, the system is configured to communicate with the display screen hardware so that the display characteristics of the image data providing the main image display received from the EGM controller or other source will be adjusted to form an unused area or void on the display screen of a desired size located between an edge of the main image display shown in the display screen and the periphery of the display screen hardware. The system is further configured to provide a second image data stream to the display screen hardware which may be added to the main image display data, an overlay on the main image display, or otherwise provided as a separate image display stream adjacent to the adjusted main image display and presented for viewing in the unused area formed subsequent to the main image display adjustment. This secondary image display may be provided independently through communication connections with the EGM and a system according to some embodiments of the invention.

In some embodiments, the system communicates with the display screen hardware and/or other components or data streams in the EGM to cause the main image display to be adjusted by resizing the main image display from between about 0.1% to about 5%. In other embodiments, the system causes the main image display to be adjusted by repositioning the game display to be moved off-center and closer to one edge of the display screen hardware. In some embodiments, the main image display is both resized and repositioned for presentation on the display screen hardware in order to form an unused area of a desired size for presenting the secondary display therein.

In some embodiments, the system communicates with the display screen hardware to consider various factors, such as the parameters of the display screen hardware and the main image display characteristics, in determining the optimal adjustment of the main image display to provide the desired unused area for the presentation of the secondary image display therein. The optimization may be set to determine the resizing and repositioning of the main image display that will result in the minimal resizing of the main image display on the display screen hardware while still providing the desired unused area for a desired secondary image display to be shown therein. The secondary image display may be an overlay image presented over the main image display on the display screen hardware.

The secondary image display may be provided by a system memory or through a remote source, and may include text or graphics. The system may communicate with a player tracking system to provide a secondary display customized to the player based on player data collected and stored in a player tracking database. Player data is typically obtained as players play games or otherwise interact with the gaming establishment in an identified manner so information regarding their interaction can be collected, that is, for example, by identifying themselves at the establishment with the player card.

In some embodiments, the system communicates with the player tracking system and, as described above, is configured for periodically conducting the steps of determining the aggregated player interaction data stored in the tracking system, determining reward criteria for implementing a player loyalty reward, comparing the aggregated player interaction data with the reward criteria to determine whether all the reward criteria has been satisfied and notifying the player of any remaining criteria that must be satisfied in order to attain a reward, or alternatively, notifying the player that a reward criteria has been satisfied, through the secondary image display. The system may be configured to periodically compare the reward point tally with reward criteria, in the form of reward point amounts, as the player accrues points from game play. The system determines the reward points necessary for the player to receive an award by calculating the difference between the tally and reward point amount and provides a secondary image display that includes a notification of the reward points necessary for the player to receive an award as players are also accruing additional reward points. Thus, they are continually updated in near real-time of the amount of points remaining until a reward will be issued.

In some embodiments, the secondary image display including the reward point notification is provided only upon a stoppage in play of the game on the main image display, that is, upon an outcome being determined. In some embodiments, the reward points necessary to obtain a reward may be updated by the outcome of the game which just occurred and the same may be included as a notification to the player in the secondary image display. For example, the secondary image display may include text, which may be scrolling or flashing on the display screen hardware, indicating that the player is 100 points away from a player loyalty award.

In other embodiments, the secondary image display may be used to provide messages or notifications of other things, such as discounts at restaurants or other things which may be of interest to players. Some of the notifications and messages may be customized or selected based on information known about the player, either by the player using their player card at the machine or based on the manner in which the player is playing the game. For example, information regarding the player stored in the player tracking base may be used to provide messages or graphics on the secondary image display which is most likely to be of interest to the player. In another example, the player's wagering nature or style may be used as a basis for selecting messages to be displayed in the secondary image display to that player.

In some embodiments in which the EGM display screens is a touch screen enabled device, the system provides graphics which are touch-enabled in the secondary image display. In some embodiments, the system is configured to detect the user touching the touch-enabled graphics, and is responsive to provide further information or options in the secondary image display accordingly. In other embodiments, the system is configured to either overlay or preempt the normal data stream which provides the main image display with a system data stream that provides a new main image display in response to detecting the user touching of a touch-enabled graphic in the secondary image display area. This new or player/operator interface display may include a variety of information and further touch-enabled graphics. The system configuration may include a physical connection with the mechanism for communicating the normal EGM data stream and a video switching device that causes the preemption of the normal data stream in favor of the system's interface data stream.

For example, the interface display provided by the system data stream may comprise a menu of touch-enabled selectable options, including the option to place a drink order, make reservations at a restaurant, find out information about upcoming shows, view show schedules, purchase tickets to a show or other items, contact other players at other machines, view videos, access the Internet, view images taken in real-time from cameras showing the action at nightclubs, the pool or lines at the buffet, etc. Players may be provided with the option to change certain personal information in their account or add personal preferences. Players may be provided with the option to use their reward points towards complimentary services or items, which would then be subtracted from their reward points in their player tracking account.

In some embodiments, the interface display includes a menu which has been customized based on information known about the player, either by the player card accessing the player tracking database or through analysis of the player's interaction with the EGM. For example, options may be provided for certain services or particular products which have been selected by the player previously. In other embodiments, players may be assigned a status, such as VIP status, based on information stored in the player tracking database and made accessible to the system upon player identification via the player card. The system may provide options through the menu to players based on the assigned status. It should be readily apparent that the system of the invention may communicate with existing systems and databases within the gaming establishment to provide some of the features discussed herein. The system of the invention may further provide a portal for allowing management to change or customize system features, such as the menu options for example.

In some embodiments, a secondary image display or overlay may be shown while a game is being played along with the main image display or shown only between games or when the EGM is inactive. In some embodiments, any touch-enabled features are only available during the period after the outcome of one game has been determined and before another game is initiated by the player. Thus, in these embodiments the main image display is never interrupted during game play by the interface display.

Figure 11:
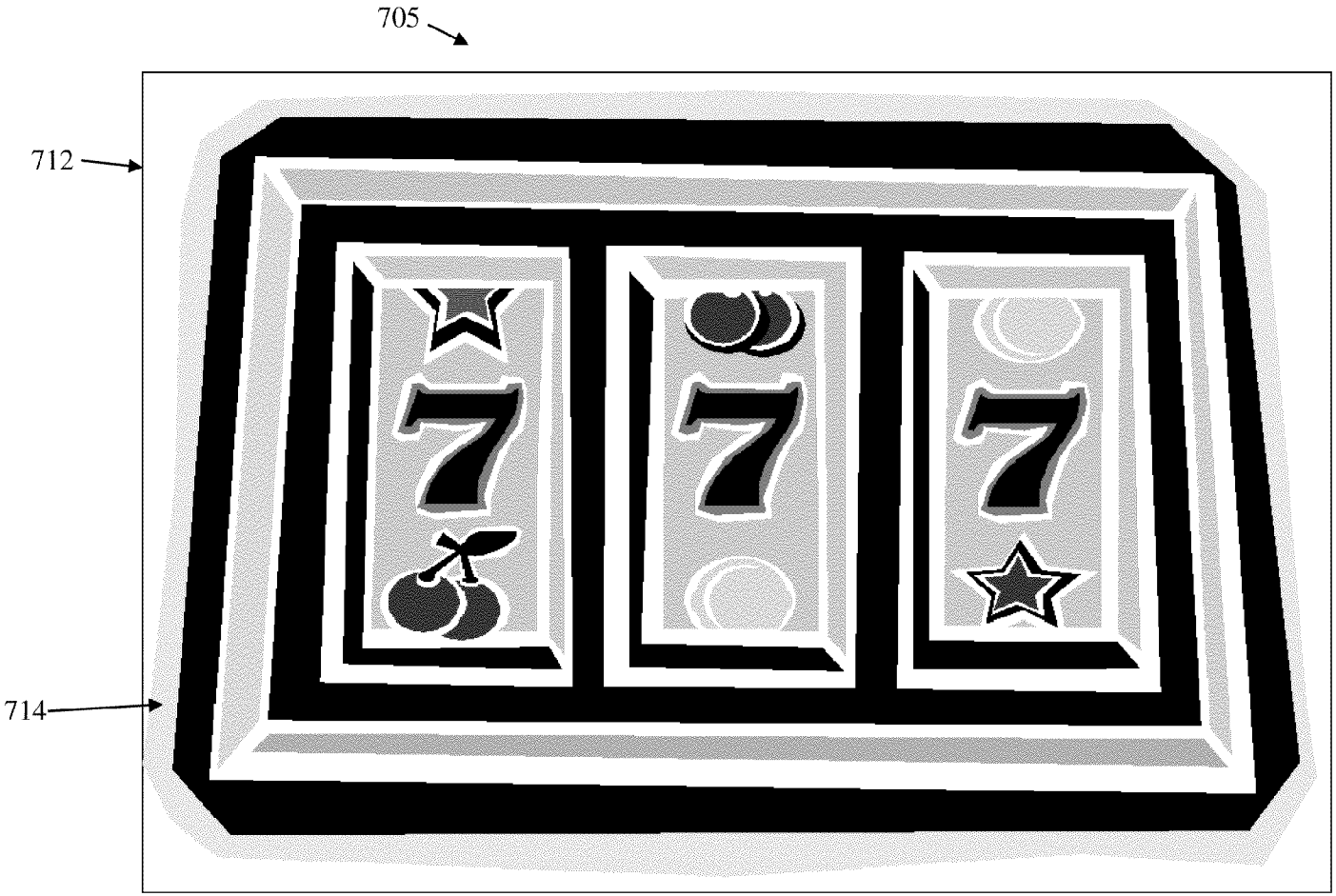
FIG. 11 is a representation of an electronic gaming machine display which may be used with embodiments of the invention.

In some embodiments, a system and method of the invention provides for the EGM main image display to be presented along with a secondary display on the EGM touch screen hardware display. FIG. 11 illustrates an EGM 705 with a display screen 712 presenting a main image display 714. Main image display 714 is an interactive, virtual representation of reel slots which is controlled by data supplied by internal components of EGM 705 and responsive to player actuation, but may be any conventional electronic gaming machine, such as a video poker machine or slot machine, in communication with a video display screen. It may be noted that main image display 714 is centered in display screen 712 which creates an unused surrounding border area between the peripheral edge of main image display 14 and the peripheral edge of display screen 712.

Figure 12:
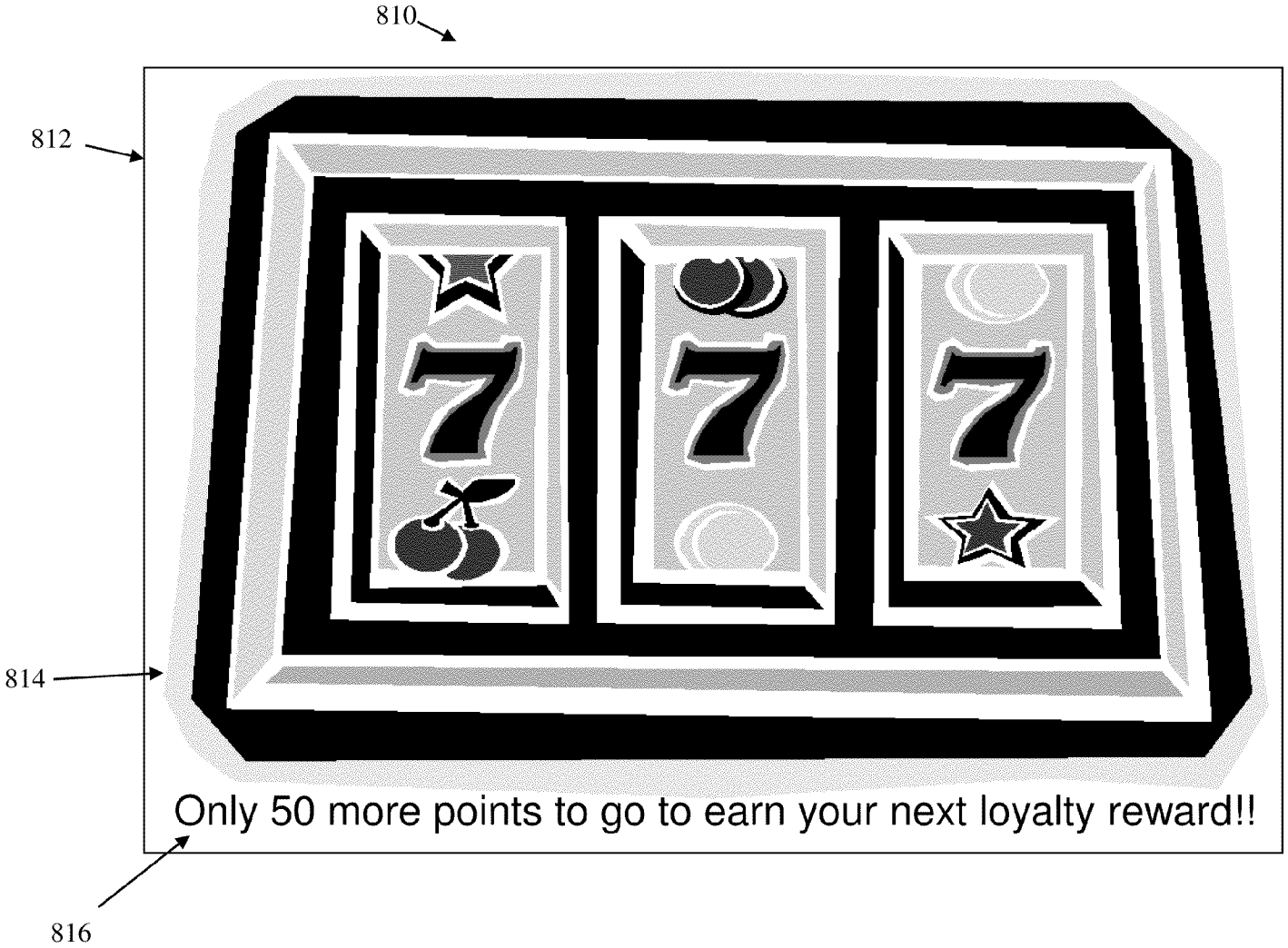
FIG. 12 is a representation of an electronic gaming machine display which illustrates exemplary features of some embodiments of the invention.

FIG. 12 illustrates system 810 installed in an EGM, such as EGM 705. As shown in this embodiment, main image display 814 has been slightly resized and repositioned on display screen 812 by system 810 to create an area for a secondary image display 816. System 810 communicates with display screen 812 to determine the screen size, and then adjusts the main image display 814 to fit secondary image display 816.

As shown in FIG. 12, system 810 is providing a message to the player in secondary display area 816 indicating that the player only has to earn 50 more reward points to earn a loyalty reward. To obtain this information system 810 is in communication with the player tracking information stored at the gaming establishment in which the EGM is installed. When a player is identified the player information is made accessible to system 810. System 810 determines the next available loyalty reward available to that player, which may be based on the player's respective status or current reward points. System 810 then compares the amount of points needed for the loyalty reward with the player's current tally of reward points and presents the amount left to earn to obtain the reward to the player in secondary image display 816 as shown. It is envisioned that such messages will benefit the gaming establishment by encouraging game play and the players by making them aware of their point accruals in order to give players more control in obtaining such rewards, among other things.

Although secondary image display 816 is shown adjacent the lower peripheral edge of the display screen 812, it should be readily apparent that main image display 814 may be adjusted by system 810 so that secondary image display 816 is on the upper periphery or adjacent the side edges.

Figure 13:
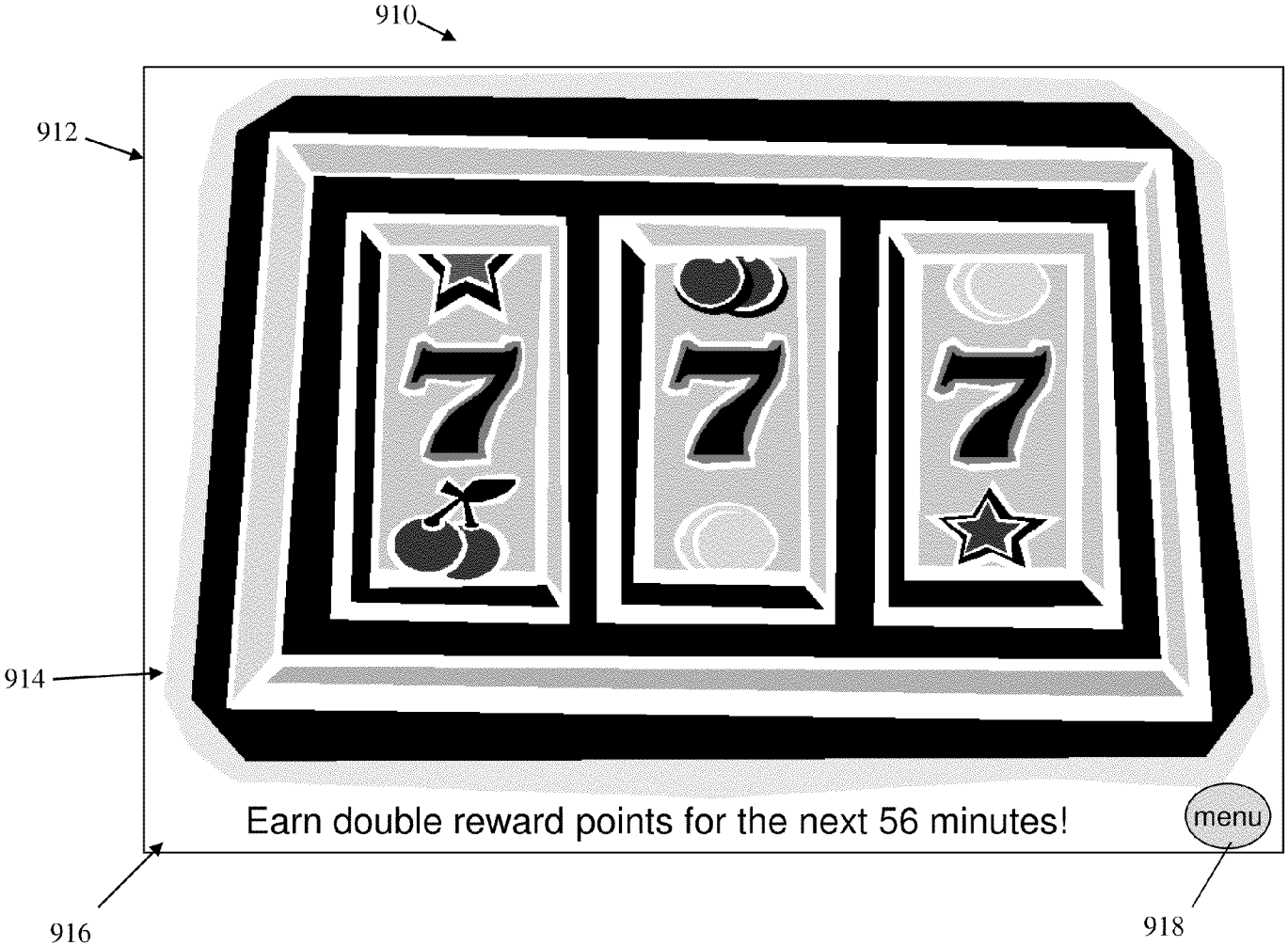
FIG. 13 is a representation of an electronic gaming machine display which illustrates exemplary features of some embodiments of the invention.

FIG. 13 illustrates a system 910 in which screen 912 is touch-enabled and secondary image display 916 includes a touch-enabled menu button 918. In this embodiment, menu button 918 is available only when the underlying game is inactive, which for purposes of this embodiment, includes the period after a game outcome has been determined and before a new game is actuated by the player. Thus, system 910 removes or otherwise deactivates menu button 918 upon detecting actuation of the underlying game presented by main image display 914 on screen 912 and then displays or reactivates menu button 918 upon detecting game inactivity. System 910 may determine game activity or inactivity by being in communication with one or more EGM components, such as the controller board, SMIB, display hardware, etc., to detect data generated by such components. System 910 is further configured to determine the EGM status from the detected data.

As shown in FIG. 13, system 910 may be used to communicate with players, encourage game play and provide interesting rewards for continued game play. In this example, the player is informed that they will be awarded double reward points during the time period of the next 56 minutes. As mentioned above, points accrue through game play. Thus, system 910 may encourage additional game play or encourage game play during off-peak times. Alternatively, players may be informed by system 910 via secondary image display 916 that double the normal amount of points will be awarded during certain hours or other added benefits may be available. System 910 may monitor the time period and points obtained during the time period through its communication with the gaming establishment player tracking database. In this embodiment, secondary image display 916 is constantly displayed even during game play. Therefore, the time may be periodically updated on secondary image display 916 as the player plays the underlying game and obtains reward points.

Figure 14:
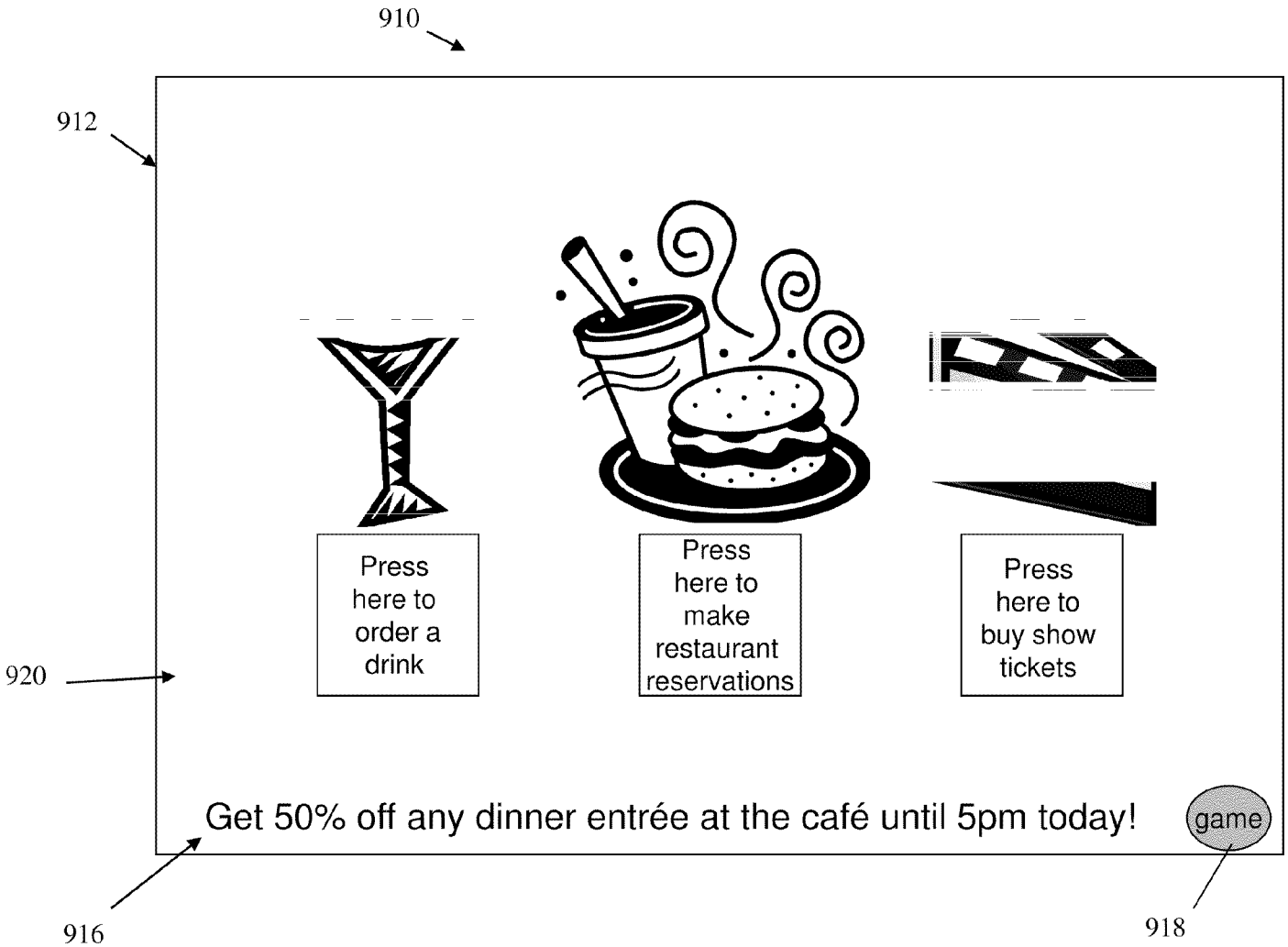
FIG. 14 is a representation of an exemplary menu content transmission which is displayed an electronic gaming machine display illustrating exemplary features of some embodiments of the invention.

FIG. 14 provides an exemplary menu image display 920. System 910 preempts main image display 914 to present menu image display 920 instead upon system 910 detecting a player touching touch-enabled menu button 918. Menu image display 920 includes options for the player to order drinks, make restaurant reservations and buy show tickets. Upon system 910 detecting a player touch selection of any of such options, system 910 would access or communicate with the gaming establishment system to facilitate the desire of the patron. For example, if a player selected the option to order a drink, the player may be provided with a selectable menu of the most popular drink options. If information regarding the respective player's last chosen drinks is stored in the player tracking database, then these drinks may be presented first to the player along with the option to select something else. In another example, if system 910 detects a player touch selection of show tickets, the player may be provided with a selectable menu of the available shows and upcoming show times. The purchase transaction may be executed by applying the cost to the player's room, via the player using the EGM card reader to swipe a credit or debit card, or by having the player finalize the transaction at a show ticket purchasing window.

As shown in FIG. 14, second image display area now includes game return button 918 instead of a menu button thus allowing players to toggle between the main image display 914 and menu display 920 during EGM inactivity.

System 910 is intended to be largely independent of the EGM, in that system 910 may detect data generated by some EGM components and assess that data but is capable of affecting only the display presented on EGM display screen 912. Thus, system 910 may be installed in any existing EGM regardless of type or manufacturer.

Gaming establishments may utilize a system such as those described herein to adjust options depending on current circumstances by adding or removing incentives. For example, if the gaming floor is crowded and EGMs are unavailable to newly arriving players, system 910 may be used to encourage players on EGMs to do something else by offering them expiring discounts on meals, inviting them to participate in poker tournaments, try a new table game or some other incentivized activity that will open up EGMs to other players. The same technique may be used subsequently should further turnover be desired. It should be readily apparent that systems such as those described herein may be used to make immediate changes to the overall dynamics and patron experience in order to maintain a preferable environment in a gaming establishment based on currently existing circumstances.

In another embodiment, the invention is directed to a system configured for communicating with the EGM display screen to provide a secondary image menu transparently displayed over the main image display upon being actuated by a touch event detected on an object which is also transparently displayed on the screen. The actuation of the object may be deactivated during game play, and reactivated during game idle times or after a game outcome and before a new game is initiated. The object may be displayed transparently over the main image display of a portion thereof.

Figure 15:
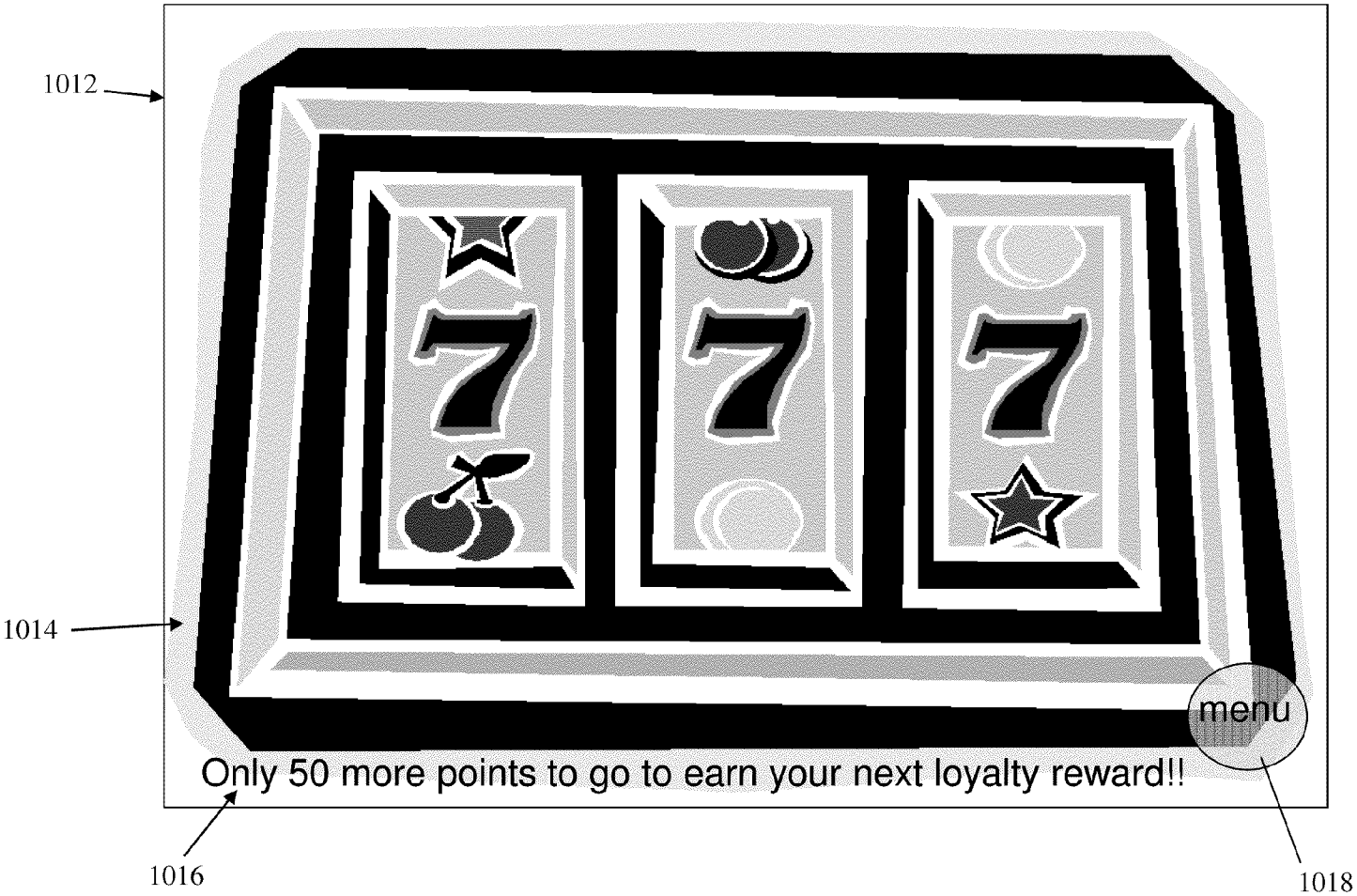
FIG. 15 is a representation of an electronic gaming machine display illustrating exemplary features of some embodiments of the invention.

In the exemplary embodiment shown in FIG. 15, a main image display 1014 is presented on an EGM display screen 1012. System 1010 provides a secondary image display of a transparent object, namely menu button 1018, over the main image display 1014 without any change to main image display 1014, and main image display 1014 is fully visible on screen 1012 along with menu button 1018. A transparent image 1016 is also provided by system 1010 and shown on display screen 1012. For purposes of illustration, image 1016 is a text message notification of the player's proximity in achieving potential reward, similar to the embodiments described above. The display of transparent objects may be facilitated through a hardware connection with the display screen and EGM video delivery components, such as the video data stream switch described above, that enables the display of transparent objects that appear to be on top of or as an overlay on the main EGM image display.

Figure 16:
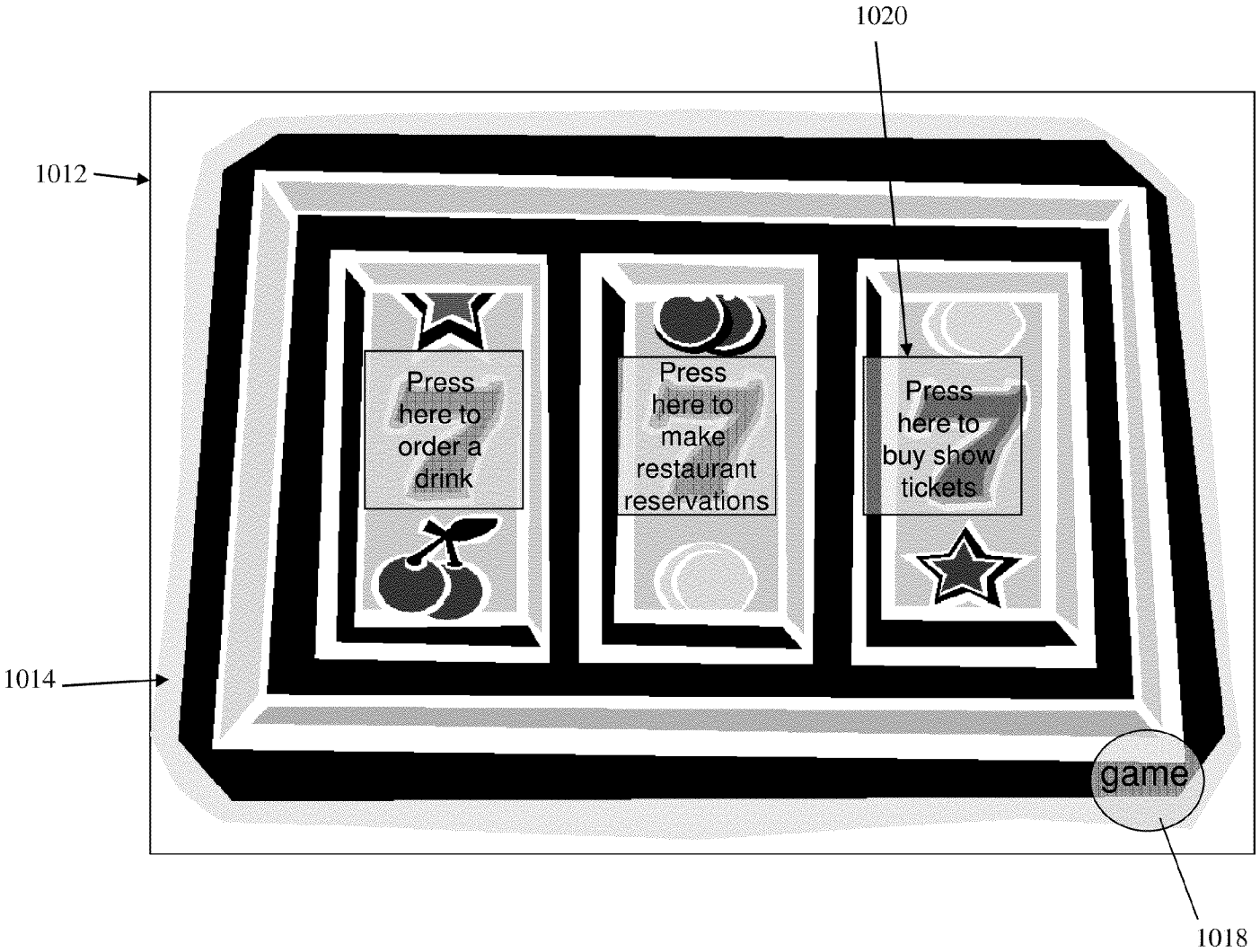
FIG. 16 is a representation of an electronic gaming machine display illustrating exemplary features of some embodiments of the invention, including transparent menu content or button overlay of the underlying gaming machine display content.

When the user touches menu button 1018, system 1010 detects the touch event and responds by presenting transparent menu image 1020 over the main image display as shown in FIG. 16. The text displayed in button 1018 is changed to read "game" and functionality is changed by system 1010 so that touching button 1018 now removes menu 1020. Once menu image 1020 is displayed, the user may select from the options presented therein. Upon system 1010 detecting a player touch selection of any of such options, system 1010 would access or communicate with the gaming establishment system to facilitate the desire of the patron.

In some embodiments, once menu 1020 is displayed, the player may not access the main image display 1014 unless either game return button 1018 is touched or a physical button (not shown) on the EGM button panel (not shown) is depressed. In other embodiments, the user may also cause the removal of menu 1020 by touching display screen 1012 in any location other than menu 1020 or a selectable option presented by menu 1020. In this example, menu image display 1020 includes options for the player to order drinks, make restaurant reservations and buy show tickets.

In some embodiments, the invention, such as a marketing device as described herein, is directed to a system configured for communicating with the EGM display screen to provide one or more hidden menu-actuation areas which are touch-enabled for detecting the a user touch or other passive object thereon, or series of touches, such as two touches in consecutive and quick succession, that is, a "double-tap" of the finger on the hidden area, or pattern of movement, such as dragging a finger on the display screen within the hidden area in a particular manner. Engaging in the actuation touching of the hidden area would result in the display of a menu. It is envisioned that notification of the hidden area and actuation touching feature may be placed on the gaming machine housing adjacent to the exterior of the display screen for users thereof to view. For example, a sticker may be placed near the lower left hand corner of the display screen indicating that the menu may be accessed by holding a finger on the lower left hand corner of the screen for three seconds.

Figure 17:
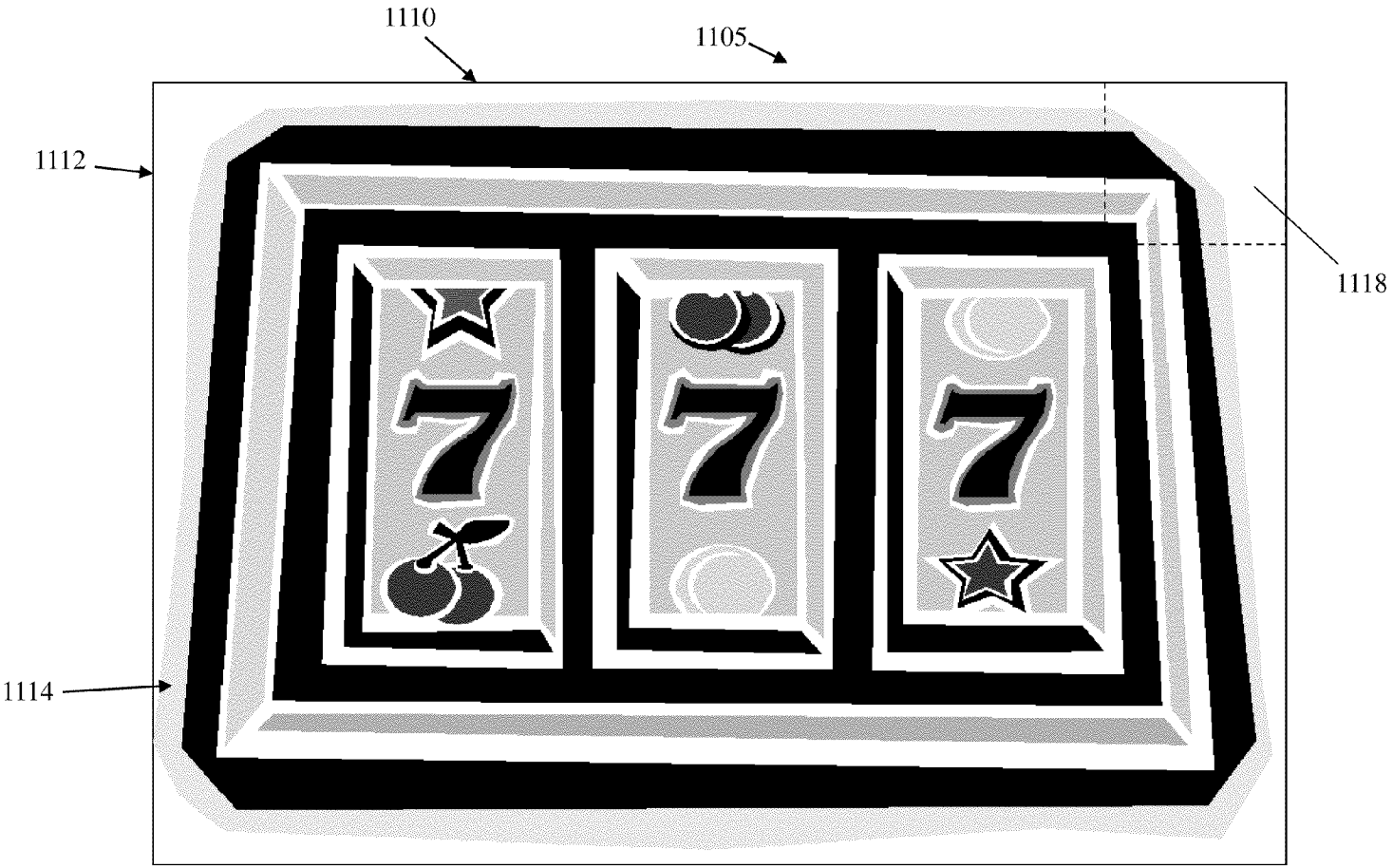
FIG. 17 is a representation of an electronic gaming machine display illustrating exemplary features of some embodiments of the invention, including an invisible menu content transmission actuation area.

FIG. 17 illustrates an EGM 1105 with a touch-enabled, that is, capable of detecting the presence and location of a player touching the screen, display screen 812 presenting a main image display 1114 thereon. Main image display 1114 is, in this exemplary embodiment, an interactive, virtual representation of reel slots which is controlled by data supplied by internal components of EGM 1105 and responsive to player actuation, but may be any conventional electronic gaming machine, such as a video poker machine or slot machine, in communication with a video display screen.

Figure 18:
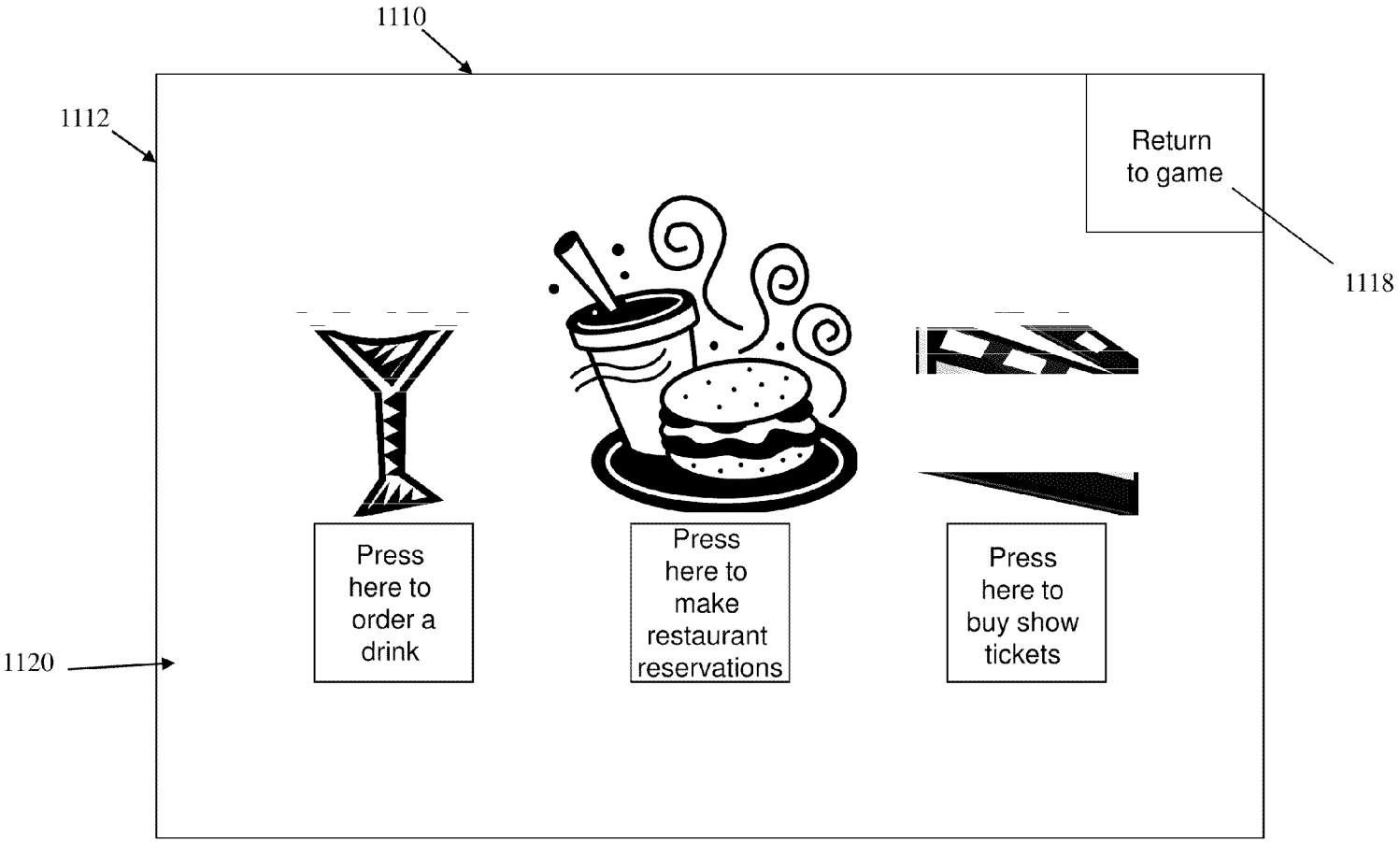
FIG. 18 is a representation of an exemplary menu content transmission which is displayed an electronic gaming machine display illustrating exemplary features of some embodiments of the invention, including various selectable options for providing additional customer services and actuating further menu content transmissions.

A system 1110 constructed in accordance with the invention, which may include the marketing devices described herein, is installed in EGM 1105. A main image display such as main image display 1114 is displayed on display screen 1112 during game play or game idle time. Although hidden area 1118 is outlined with dashed lines, this is for illustrative purposes as it is not visible on display screen 1112 while main image display 1114 is displayed on display screen 1112. However, users may touch hidden area 1118 while main image display 1114 is displayed, which will be detected by system 1110. If the touch event detected satisfies a preset touch requirement, such as a double-tap touch event within hidden area 1118, then a menu 1120 will be activated as shown in FIG. 18. Hidden area 1118 may be disabled during some or all of game play events on the EGM.

In this embodiment, hidden area 1118 is square-shaped and located adjacent to the upper right hand corner of display screen 1112. Thus, there may also be a sticker, sign or indicia disposed on the EGM housing adjacent to the right hand corner indicating that the menu is available by double-tapping the upper right hand corner of the display screen. It should be understood that hidden area 1118 may be positioned at any location on display screen 1112, and may be of any size or shape. Alternatively, the menu may be activated by touching on a different display screen mounted on the EGM other than the display screen displaying the main image display.

Once menu 1120 is displayed, users may be provided with various selectable options, such as those examples illustrated in FIG. 18 and described generally herein with regard to patron services or things of interest to players. Hidden area 1118 may remain hidden or be visually displayed as a button 1118 as part of menu 1120 as shown in FIG. 18. A touch event within hidden area or button 1118 would be detected by system 810 and main display 1114 would be shown on screen 1112 once again in response thereto. The touch event necessary within button 1118 of menu 1120 may differ to return to the game then the touch event required to actuate menu 1120.

Figure 19:
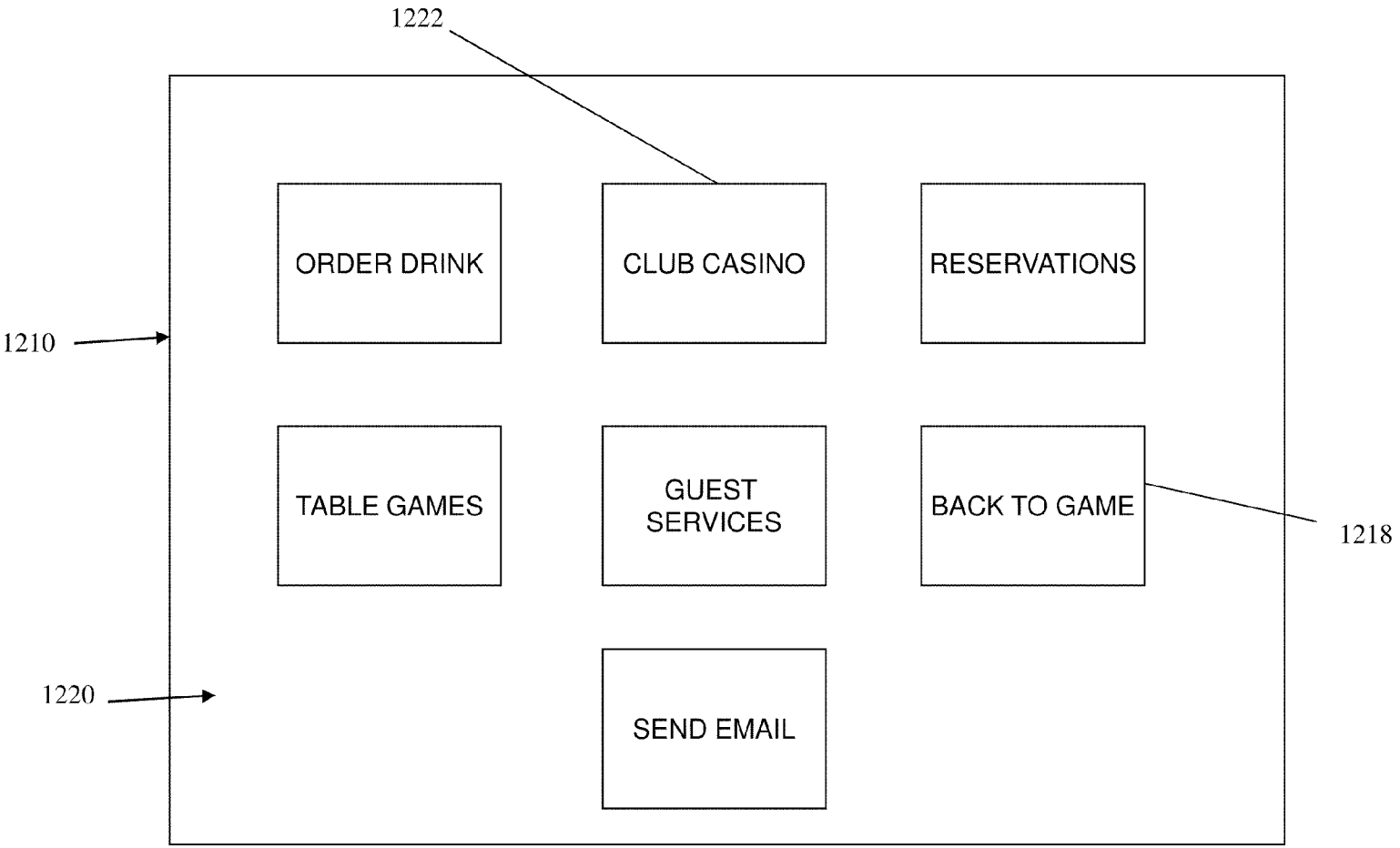
FIG. 19 is a representation of an exemplary menu content transmission which is displayed an electronic gaming machine display illustrating exemplary features of some embodiments of the invention, including various selectable options for providing additional customer services and actuating further menu content transmissions.

Another example of a menu screen actuated by a hidden area, such as hidden area 1118 described above, is shown by menu 1220 in FIG. 19 of a system 1210. Thus, when hidden area 1118 is double-tapped, in this embodiment, menu screen 1220 will be displayed, which includes selectable options for accessing reservations, placing drink orders, contacting guest services, playing table games for fun or real money, or for returning to the game through button 1218. In this embodiment, a loyalty club, which patrons may join to receive rewards or "comp" benefits when playing gaming machines or otherwise engaging in transactions within certain establishments, may be accessible through a button 1222 in menu 1220, which in this embodiment refers to "Club Casino." Once depressed, a screen may be provided to access the Club if the player has already inserted information or a player tracking card to identify themselves at the EGM. Alternatively, a screen may be provided to inquire whether the user is a Club Casino member. If the user is already a Club Casino member, then the user can press "yes" to access information regarding their account, such as their current reward points. In some embodiments, the user may apply the reward points to redeem rewards. Should the user not be a member of the club, a membership sign up screen may be provided for the user to enter information to become a member of the loyalty club, and either after a verification process or immediately thereafter gain access to the benefits of club membership. It should be understood that additional screens and buttons may be provided as necessary for the user to enter in the necessary information and return to the main menu or game.

Figure 20:
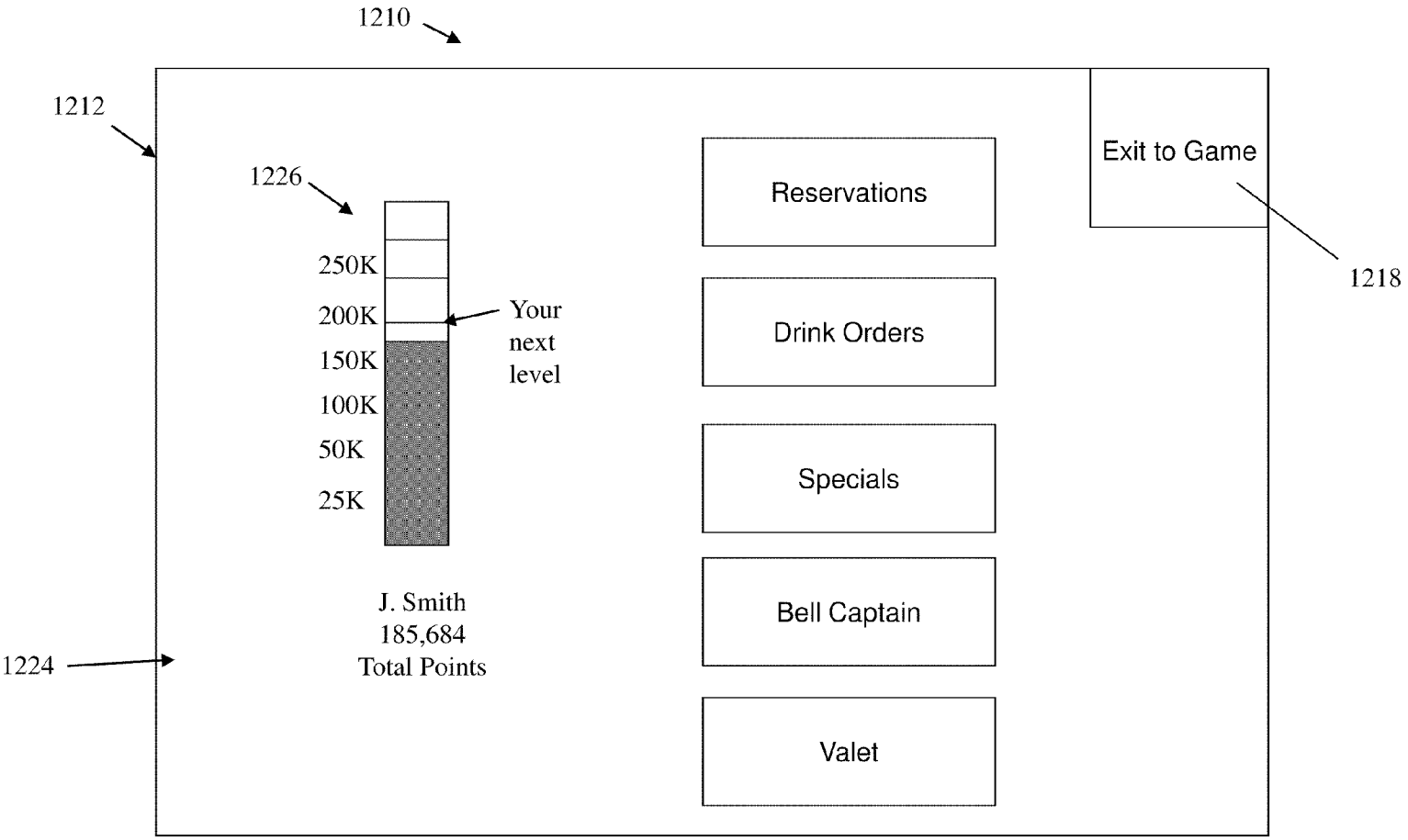
FIG. 20 is a representation of an exemplary menu content transmission which is displayed an electronic gaming machine display illustrating exemplary features of some embodiments of the invention, including various selectable options for providing additional customer services, actuating further menu content transmissions and a display of player award points.

FIG. 20 illustrates an exemplary menu screen 1224 which may be accessed by actuating a hidden area on the EGM display screen, such as hidden area 1118, or through selecting the Club Casino button 1222 upon obtaining player identification. System 1210 of this embodiment is configured to store data or otherwise access external databases regarding available comps, special discounts or other offers for goods or services to provide to players through menu 1224. In this embodiment, system 1210 is able to determine availability and provide offers for events or features that are effective only in the future, such as the following day, following weekday or weekend, or for any future day in which the casino wishes to encourage further patronage. System 1210 is configured to provide at least one method for redeeming the offer, which may include transmission of e-mail or text message (Short Message Service or Multimedia Message Service), either by having players enter contact information or through contact information stored in the player loyalty club electronic file for players who identify themselves as such at the EGM. Offers may also be provided as coupons through the onboard EGM ticket printer or a separate remote printer upon player selection. Menu 1224 may also be used to make reservations, order beverages or food, contact staff or access other services at the establishment.

System 1210 may further include a bar code generator for generating bar codes which are readable by mobile phones with cameras, such as a "QR Code" which is readable by mobile phones with cameras and QR scanner software. System 1210 can provide such readable bar codes on menu 1224 along with the offers presented, thus allowing players to obtain a coupon for an offer on the display screen 1212 or a digital ticket by capturing a picture of the code associated with the offer which may be subsequently redeemed electronically.

System 1210 may be configured to provide a graphic depicting the player's current reward point tally and the next achievable comp level for the player, such as graphic 1226, a graduated bar graph or a thermometer with mercury, etc., on menu screen 1224 customized according to the particular player's loyalty or reward point information. In some embodiments, players may actuate a print of this graphic via the EGM ticket printer. Menu screen 1224 may also provide the player's status, such as silver, gold or platinum member of the loyalty club. In some embodiments, player may use menu 1224 to apply points to execute transactions, such as using the points to pay for goods or services at the establishment.

System 1210 may also be configured to determine when a player has wagered a preset amount at the EGM, that is, the player's coin-in amount. In this embodiment, upon determining that the player has reached a preset coin-in, system 1210 is configured to cause a coupon to print from the EGM ticket printer.

Figure 21:
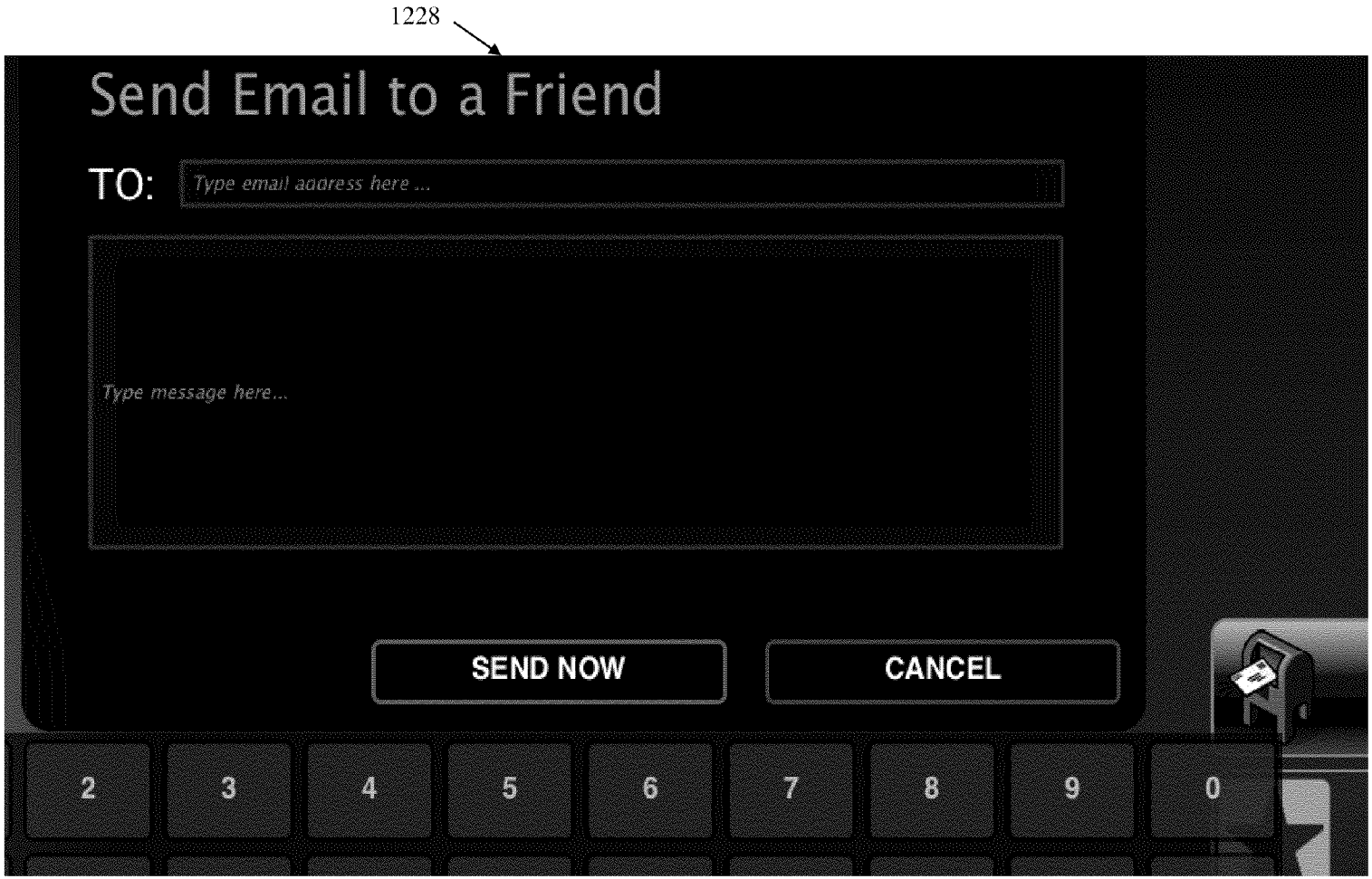
FIG. 21 is a representation of a screen for providing email transmission at an EGM illustrating exemplary features of some embodiments of the invention, among other things.

In some embodiments, a system such as system 1110 further provides users with the ability to communicate electronically with others. Such communications may utilize the independent communication connection between multiple systems 1110, as described above, which may be further in communication with an external network or Internet. Alternatively, system 1110 may include a wireless transceiver which is capable of connecting to a wireless network. System 1110 may therefore provide for communications such as emails instant messages (SMS or MMS), which may be proprietary or otherwise. Systems constructed in accordance with the invention may also allow users to chat or engage in social networking activities through a proprietary site or by connecting to social networking websites on the Internet. It should be understood that system 1110 may impose certain restrictions on communications it will permit. FIG. 21 illustrates a screen 1228 which is accessible through a selectable option provided in menu 1220 that further provides users with the opportunity to send emails. This option may be made available only to Club Casino members or all users. In this embodiment, system 1110 is configured to allow users to send emails to others at any email address. Users may also save email addresses of contacts or friends which may be stored in connection with the user in a player database in communication with system 1110. System 1110 is also configured in this embodiment to attach an add-on to any email or other communication sent by users thereof. The add-on may comprise a banner or text in the body of the email, an attached file to the email, or a separate email sent to the same email address to which the user sends their emails. The add-on may consist of a special promotional offer or discount or any other offer which may be of interest to its receiver. System 1110 may be configured to select add-ons based on any information regarding the user contained in the player tracking system or database or from the text of the email or communication sent. Although not show herein, users may be provided with a selectable option to opt-out of the add-on feature prior to sending a communication via system 1110.

In some embodiments, system 1110 is configured to provide users with preset options for any communications transmitted through screens such as screen 1228. In some embodiments, users are able to select the content of communication from a list of possible content. For example, the content may include text, such as "having a great time, wish you were here," which may also include information about the establishment or location and/or a preset picture of any kind, such as a picture of the establishment or of a landmark. In some embodiments, the user may be offered to select from content that relates to an add-on to the communication. For example, the user may select content which includes an offer along with information regarding the establishment, such as "I'm here tonight, and if you come by we'll both receive a 50% discount on dinner" and the add-on to the communication may comprise a coupon relating thereto. Alternatively, the user may be able to select from a variety of special offers or features that could be transmitted as the content of the communication. In other embodiments, system 1110 may automatically add content, such as an offer relating to the add-on, to any communication transmitted. In some embodiments, the user is rewarded with points or a special offer for using system 1110 to transmit communications.

System 1110 may automatically include the user's name in the communication, which is known via the user having identified themselves prior to accessing system 1110. In some embodiments the user may not be permitted to customize the communication other than as described herein. The user would be able to input the email address, phone number or other identification for the receiver of the communication, which may be also be verified thereafter with the receiver or via the player tracking database if the receiver is included therein.

A special reply or other feature accessible to the receiver may be included with the communication. For example, the receiver may reply to the communication to obtain an additional benefit, confirm a benefit, such as a reservation in which the case the reply may be directed to a venue or restaurant, or submit information to sign up for a player loyalty program. In another example, a feature may be included which either facilitates the offer, if an offer is included with the communication, such as by providing directions to the establishment or a hyperlink to a venue webpage, or facilitates the process of signing up the receiver for benefits through the player loyalty system, such as a hyperlink which is capable of connecting the receiver to a special signup webpage. It should be readily apparent that the communication options and content offered may vary in a system according to the invention. For example, a system provided herein may also provide various applications to facilitate socializing, such as applications for chat or blogging or otherwise facilitate access to existing social networking webpages to place status or blog updates, among other things.

It should be readily apparent that many added benefits and additional features and functions may be realized by the systems or devices and methods of the invention, at least in part because embodiments of the invention are in communication with an EGM and configured to receive data relating to operations and activity occurring at the EGM, while also collectively being in communication with an independent system or device for transceiving data via a wireless or wired connection, among other things, as discussed above.

In some embodiments, systems constructed according to the invention interface with EGM components and peripherals, such as the video, touch-screen, printer, bill validator and SAS or G2S of existing EGM or slot machines, and the application programming interface or API to the network used by the operator, which allows for the creation of applications that provide additional features or services through communication with onboard EGM peripherals or remote systems, such as the internet and the operator or casino back-end player tracking and resort management systems in order to facilitate better customer relationship management, among other things.

Figure 22:
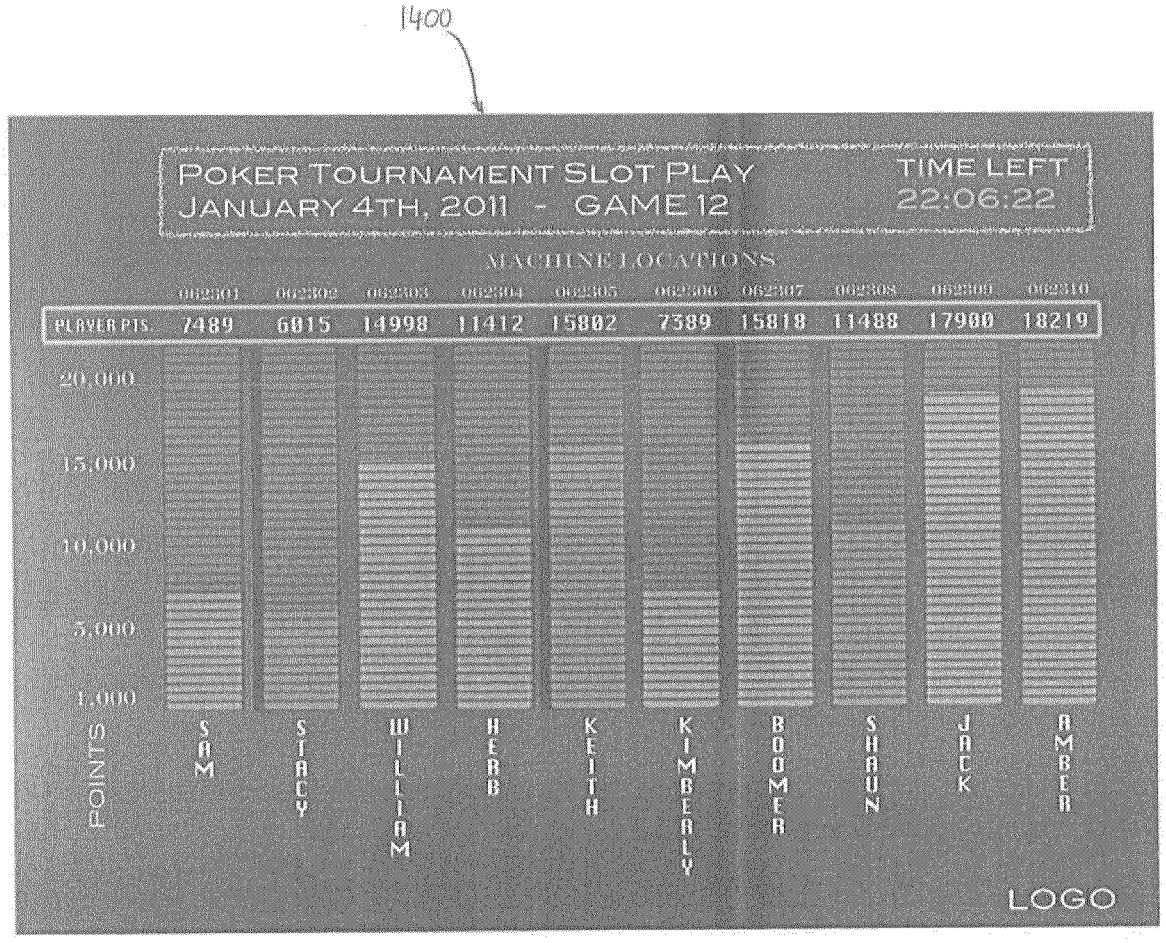
FIG. 22 is a representation of a screen for providing tournament play at one or more EGMs illustrating exemplary features of some embodiments of the invention.

FIG. 22 provides an exemplary screen for illustrating one such added functionality along with an exemplary method of operation that may be incorporated in an embodiment of a marketing device constructed in accordance with the invention, such as marketing device 500. In this embodiment, the marketing device is configured to facilitate a tournament mode of operation for a plurality of EGMs.

By way of background, EGM tournaments, whether involving electronic or video poker, slots, blackjack or something else, typically follow a similar format. Players sign up for the tournament and are assigned an EGM number and a session time to play. All Players are given the same set amount of credits which must be played within the session time. Most EGMs include a preset tournament mode of operation that allows the EGM to be activated for the tournament and includes various selectable options, such as the duration of the tournament and starting credits. For example, a common tournament setup involves giving each player 1,000 credits on an EGM with 20 minutes to play them. Each time the player places a wager, the wagered amount will be deducted from their starting credits. The credits that the player wins from placing winning wagers will be tallied separately from the starting credits, as the players typically do not get to replay credits attributed to winning wagers. When the session time ends the EGM will usually enter a locked state so that no further play is allowed. Any credits not played by the player will be lost. The tally of credits from winning wagers is typically taken as the player's score in the tournament. Alternatively, the tally of credits from winning wagers and the amount of starting credits remaining at the end of the session are combined to form the player's score in the tournament. The score will be recorded by a tournament official and then compared to the scores of the other players in the tournament to determine a winner.

In this embodiment, the marketing device of the invention is configured to enter a tournament mode in which certain "EGM tournament data" is received or otherwise recognized by the marketing device for each EGM involved in a tournament, some of which may be presented in real-time to tournament players and officials. The EGM tournament data may include a variety of information, such as for example, the time remaining in the tournament or current session, player and/or EGM or machine identification information, and real-time score or tally of credits from winning wagers during the session as the score changes according to the rules of the tournament.

Screen 1400 in FIG. 22 illustrates an embodiment of the invention in which real-time tournament information is presented on any display viewable to players, which includes a portion of the main EGM display device, a secondary EGM display such as the topbox display device, or on an independent display. In this embodiment, screen 1400 includes a bar chart with player identification presented horizontally along the bottom and player points or score achieved presented vertically, wherein the chart is depicted to somewhat resemble a graphic equalizer with LED-like lights of different colors representing each of the player's real-time score in the tournament. The time remaining is shown in the upper portion of screen 1400. The LED-like lights may fluctuate as the player's score fluctuates.

In operation, all players in the tournament will begin at the same level, but the players will be able to view in real-time their score relative to other players in the tournament thereafter as the tournament progresses to a close. Although not shown in screen 1400, other information may be provided such as the highest score of any player so far in the tournament, which may have been achieved by a player in an earlier session if the tournament is separated into multiple sessions. By presenting this information to tournament players, this embodiment of the invention facilitates an exciting and competitive atmosphere, and obviates the need for tournament officials to record and compare scores, among other things.

Those skilled in the art will readily appreciate that methods and systems of the embodiments of the invention may include various computer and network related software and hardware, such as programs, operating systems, memory storage devices, input/output devices, processors, servers, data communication links, whether wireless or otherwise, and data transceiving devices which are not already mentioned herein. Those skilled in the art will further appreciate that the precise types of software and hardware used are not vital to the full implementation of the embodiments of the invention so long as they are provided in accordance with the methods and systems described herein.

It should be understood that the embodiments of the present invention may be implemented to deliver presentation data to one or more EGMs, gaming establishments and throughout multiple jurisdictions. Moreover, the systems and methods according to the embodiments of the present invention are suitable for non-gambling electronic devices (e.g., arcade games). Furthermore, it should be understood that the selectable options may be linked with activities, events, actions or automated features other than those presented herein.

While exemplary methods and applications of the systems and methods of the marketing device of the embodiments of the present invention have been described herein, it should also be understood that the foregoing is only illustrative of exemplary and/or preferred embodiments, as well as principles of the embodiments of the present invention, and that various modifications can be made by those skilled in the art without departing from the scope and spirit of the embodiments of the present invention. Therefore, the described embodiments should not be considered as limiting of the present invention in any way. Accordingly, the present invention embraces alternatives, modifications and variations which fall within the spirit and scope of the marketing device described herein.

What is claimed is:

1. A method of presenting menu content via an electronic gaming machine, said electronic gaming machine including at least a controller, memory, game player interface and touch screen display, comprising the steps of:

displaying an object at a preset position on the touch screen display;

detecting data signals generated by the electronic gaming device during play sessions and idle time;

receiving player identification information for identifying the player in a loyalty program and displaying a real-time notification of player loyalty award points on the touch screen display;

transmitting menu content to the display responsive to the detection of the data signals associated with gaming device idle time and the receipt of a menu actuation signal, wherein the menu actuation signal is generated upon the detection of a touch event occurring at the preset position of the object.

2. The method of claim 1, wherein the object is transparently displayed.

3. The method of claim 1, further comprising printing a ticket upon receiving a corresponding ticket printing signal during the transmission of menu content.

4. The method of claim 1, wherein the transmission of menu content to the display is responsive to the receipt of a menu actuation signal only upon the detection of the data signals associated with gaming device idle time.

5. The method claim 1, further comprising the step of rendering play sessions inaccessible for play upon the transmission of menu content to the display.

6. The method of claim 1, wherein the step of displaying a real-time notification of player loyalty award points on the touch screen display further comprises displaying the real-time notification within the object.

7. The method of claim 1, further comprising the step of displaying a real-time notification of the amount of additional player loyalty award points necessary to receive a bonus on the touch screen display.

8. The method of claim 1, wherein the menu content includes a selectable area for terminating the transmission of menu content responsive to the detection of touch event thereon.

9. The method of claim 8, wherein play sessions are disabled for play upon transmission of the menu content and enabled upon termination of the transmission of the menu content.

10. A method of presenting menu content via an electronic gaming machine configured to provide game sessions involving play of a game associated with the electronic gaming machine, the electronic gaming machine including at least a controller, memory, game player interface and touch screen display, the method comprising the steps of:

receiving player identification information for identifying the player in a loyalty program;

displaying an object at a preset position on the touch screen display;

detecting a touch event occurring at the preset position of the object;

detecting data signals generated by the electronic gaming device during game sessions and idle time;

transmitting menu content to the display responsive to the receipt of a menu actuation signal, wherein play of the game associated with the electronic gaming machine is disabled upon transmission of menu content; and displaying a real-time notification of player loyalty award points on the touch screen display.

11. The method of claim 10, wherein the object is transparently displayed.

12. The method of claim 10, further comprising printing a ticket upon receiving a corresponding ticket printing signal during the transmission of menu content.

13. The method of claim 10, wherein the step of displaying a real-time notification of player loyalty award points on the touch screen display further comprises displaying the real-time notification within the object.

14. The method of claim 10, further comprising the step of displaying a real-time notification of the amount of additional player loyalty award points necessary to receive a bonus on the touch screen display.

15. The method of claim 10, wherein the menu content includes a selectable area for terminating the transmission of menu content responsive to the detection of touch event thereon.

16. The method of claim 10, wherein play of the game associated with the electronic gaming machine is enabled upon termination of the transmission of the menu content.

17. A method of presenting menu content via an electronic gaming machine configured to open game sessions involving play of a game associated with the electronic gaming machine, the electronic gaming machine including at least a controller, memory, game player interface and touch screen display, the method comprising the steps of:

receiving player identification information for identifying the player in a loyalty program;

displaying an object at a preset position on the touch screen display;

detecting a touch event occurring at the preset position of the object;

detecting data signals associated with an open game session and game idle;

transmitting menu content to the display responsive to the receipt of a menu actuation signal, wherein play of an open game session is disabled upon transmission of menu content; and displaying a real-time notification of player loyalty award points on the touch screen display.

18. The method of claim 17, wherein the object is transparently displayed.

19. The method of claim 17, wherein the step of displaying a real-time notification of player loyalty award points on the touch screen display further comprises displaying the real-time notification within the object.

20. The method of claim 17, further comprising the step of displaying a real-time notification of the amount of additional player loyalty award points necessary to receive a bonus on the touch screen display.

21. The method of claim 17, wherein opening new game sessions is inaccessible upon transmission of the menu content.

22. The method of claim 17, wherein the menu content includes a selectable area for terminating the transmission of menu content responsive to the detection of touch event thereon.

23. The method of claim 17, wherein play of the open game session is enabled upon termination of the transmission of the menu content.

* * * * *